US011843202B2

(12) United States Patent
Chen et al.

(10) Patent No.: US 11,843,202 B2
(45) Date of Patent: Dec. 12, 2023

(54) ELECTRICAL CONNECTOR WITH IMPROVED GROUNDING BAR

(71) Applicant: Dongguan Luxshare Technologies Co., Ltd, Dongguan (CN)

(72) Inventors: MaoShan Chen, Dongguan (CN); RongZhe Guo, Dongguan (CN); HongJi Chen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 49 days.

(21) Appl. No.: 17/512,859

(22) Filed: Oct. 28, 2021

(65) Prior Publication Data

US 2022/0231464 A1 Jul. 21, 2022

(30) Foreign Application Priority Data

Jan. 18, 2021 (CN) ..... 202110065322.4

(51) Int. Cl.
*H01R 13/6581* (2011.01)
*H01R 13/6597* (2011.01)

(52) U.S. Cl.
CPC ..... *H01R 13/6581* (2013.01); *H01R 13/6597* (2013.01)

(58) Field of Classification Search
CPC ..... H01R 13/6581; H01R 13/6597
USPC ..... 439/607.34
See application file for complete search history.

(56) References Cited

U.S. PATENT DOCUMENTS 8,545,240 B2 10/2013 Casher et al.
8,550,855 B2 * 10/2013 Zhang ..... H01R 13/405 439/636
8,702,451 B2 * 4/2014 Luo ..... H01R 12/725 439/637
9,362,681 B2 * 6/2016 Yu ..... H01R 13/6587
9,490,585 B2 * 11/2016 Yang ..... H01R 13/6585
9,496,657 B1 * 11/2016 Chang ..... H01R 13/6471
9,647,395 B2 * 5/2017 Hsu ..... H01R 43/24
(Continued)

FOREIGN PATENT DOCUMENTS

CN 103250306 A 8/2013
CN 204167554 U 2/2015
(Continued)

*Primary Examiner* — Peter G Leigh
(74) *Attorney, Agent, or Firm* — Birch, Stewart, Kolasch & Birch, LLP

(57) ABSTRACT

The present disclosure provides an electrical connector, comprising an insulating body, a first terminal module, a second terminal module, and an electromagnetic shielding component. The insulating body comprises a first surface, a second surface, a terminal accommodating groove, a plurality of first terminal plugging slots, and a plurality of second terminal plugging slots. The first terminal module comprises a plurality of first signal terminals, a plurality of first ground terminals, and a first terminal insulating body. The second terminal module comprises a plurality of second signal terminals and a plurality of second ground terminals. The electromagnetic shielding component is disposed at the insulating body or/and at the first terminal insulating body. The electromagnetic shielding component is in contact with the plurality of first ground terminals and the plurality of second ground terminals.

33 Claims, 20 Drawing Sheets

(56) References Cited

U.S. PATENT DOCUMENTS

| | | | | |
|---|---|---|---|---|
| 9,653,849 | B2 * | 5/2017 | Hsu | H01R 13/6593 |
| 9,893,446 | B1 | 2/2018 | Wu et al. | |
| 9,917,405 | B2 * | 3/2018 | Ju | H01R 13/6591 |
| 9,979,136 | B1 | 5/2018 | Wu et al. | |
| 10,135,197 | B2 * | 11/2018 | Little | H01R 12/58 |
| 10,367,308 | B2 * | 7/2019 | Little | H01R 13/6658 |
| 10,446,986 | B2 * | 10/2019 | Zhong | H01R 13/6585 |
| 10,470,313 | B1 | 11/2019 | Phillips et al. | |
| 10,601,181 | B2 | 3/2020 | Lu et al. | |
| 10,784,606 | B2 * | 9/2020 | Cheng | H01R 13/115 |
| 2012/0108109 | A1 * | 5/2012 | Zhang | H01R 12/721 439/629 |
| 2013/0149882 | A1 * | 6/2013 | Luo | H01R 13/652 439/108 |
| 2014/0206231 | A1 * | 7/2014 | Guo | H01R 13/6594 439/607.01 |
| 2017/0033508 | A1 * | 2/2017 | Hsu | H01R 13/405 |
| 2020/0076131 | A1 | 3/2020 | Hu et al. | |

FOREIGN PATENT DOCUMENTS

| | | | | | |
|---|---|---|---|---|---|
| CN | 102282731 | B | | 10/2015 | |
| CN | 102714363 | B | | 11/2015 | |
| CN | 103477503 | B | | 1/2016 | |
| CN | 205335540 | U | * | 6/2016 | |
| CN | 205595487 | U | | 9/2016 | |
| CN | 106410517 | A | | 2/2017 | |
| CN | 206163778 | U | * | 5/2017 | |
| CN | 107026341 | A | * | 8/2017 | H01R 13/2414 |
| CN | 107359450 | A | * | 11/2017 | H01R 12/51 |
| CN | 107394521 | A | * | 11/2017 | H01R 12/51 |
| CN | 107658616 | A | * | 2/2018 | H01R 12/51 |
| CN | 207199871 | U | * | 4/2018 | |
| CN | 207250764 | U | * | 4/2018 | |
| CN | 108808312 | A | | 11/2018 | |
| CN | 208608398 | U | | 3/2019 | |
| CN | 208753607 | U | | 4/2019 | |
| CN | 208797211 | U | * | 4/2019 | H01R 12/721 |
| CN | 109962353 | A | | 7/2019 | |
| CN | 209374758 | U | | 9/2019 | |
| CN | 110867681 | A | | 3/2020 | |
| CN | 111313180 | A | | 6/2020 | |
| CN | 111342272 | A | | 6/2020 | |
| CN | 111342273 | A | | 6/2020 | |
| CN | 211605562 | U | | 9/2020 | |
| CN | 111769395 | A | | 10/2020 | |
| TW | M558483 | U | | 4/2018 | |
| TW | M581318 | U | | 7/2019 | |
| TW | M604977 | U | | 12/2020 | |

* cited by examiner

ELECTRICAL CONNECTOR WITH IMPROVED GROUNDING BAR

CROSS-REFERENCE TO RELATED APPLICATION

This application claims the priority benefit of Chinese Patent Application Serial Number 202110065322.4, filed on Jan. 18, 2021, the full disclosure of which is incorporated herein by reference.

BACKGROUND

Technical Field

The present disclosure relates to the technical field of connector, particularly to an electrical connector.

Related Art

For pursing excellent signal transmission performance for conventional electrical connectors, electromagnetic shielding members are often installed to the electrical connectors to electromagnetically shield the plurality of signal terminals of electrical connectors and to effectively improve the signal transmission performance of electrical connectors. However, conventional electrical connectors are mostly formed on the insulating body or terminal module of the electrical connectors by means of secondary molding, which increases the complexity for production with low arbitrarily for replacing, resulting in inconvenience of use.

SUMMARY

The embodiments of the present disclosure provide an electrical connector tended to solve the problem that conventional electromagnetic shielding members are formed on the insulating body or terminal module of the electrical connectors by means of secondary molding that increases the complexity for production with low arbitrarily for replacing, resulting in inconvenience of use.

The present disclosure provides an electrical connector, comprising an insulating body, a first terminal module, a second terminal module, and an electromagnetic shielding component. The insulating body comprises a first surface, a second surface, a terminal accommodating groove, a plurality of first terminal plugging slots, and a plurality of second terminal plugging slots. The first surface and the second surface are oppositely disposed and are disposed in a first direction. The plurality of first terminal plugging slots and the second terminal plugging slots are disposed at intervals at one side of the terminal accommodating groove along a second direction orthogonal to the first direction. The first terminal module comprises a plurality of first signal terminals, a plurality of first ground terminals, and a first terminal insulating body. The first terminal insulating body covers a part of the plurality of first signal terminals and the plurality of first ground terminals. The first terminal insulating body is disposed in the terminal accommodating groove. The second terminal module comprises a plurality of second signal terminals and a plurality of second ground terminals. The plurality of second signal terminals are respectively assembled in the plurality of first terminal plugging slots. The plurality of second ground terminals are respectively assembled in the plurality of second terminal plugging slots. The electromagnetic shielding component is disposed at the insulating body or/and at the first terminal insulating body. The electromagnetic shielding component is in contact with the plurality of first ground terminals and the plurality of second ground terminals.

In the embodiments of the present disclosure, by disposing the electromagnetic shielding component in the insulating body or/and the first terminal insulating body of the first terminal module in a physical mounting manner, the assembling can be easy and the complexity of manufacturing can be reduced. Meanwhile, the electromagnetic shielding components can be arbitrarily replaced, which greatly improves the convenience of use.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
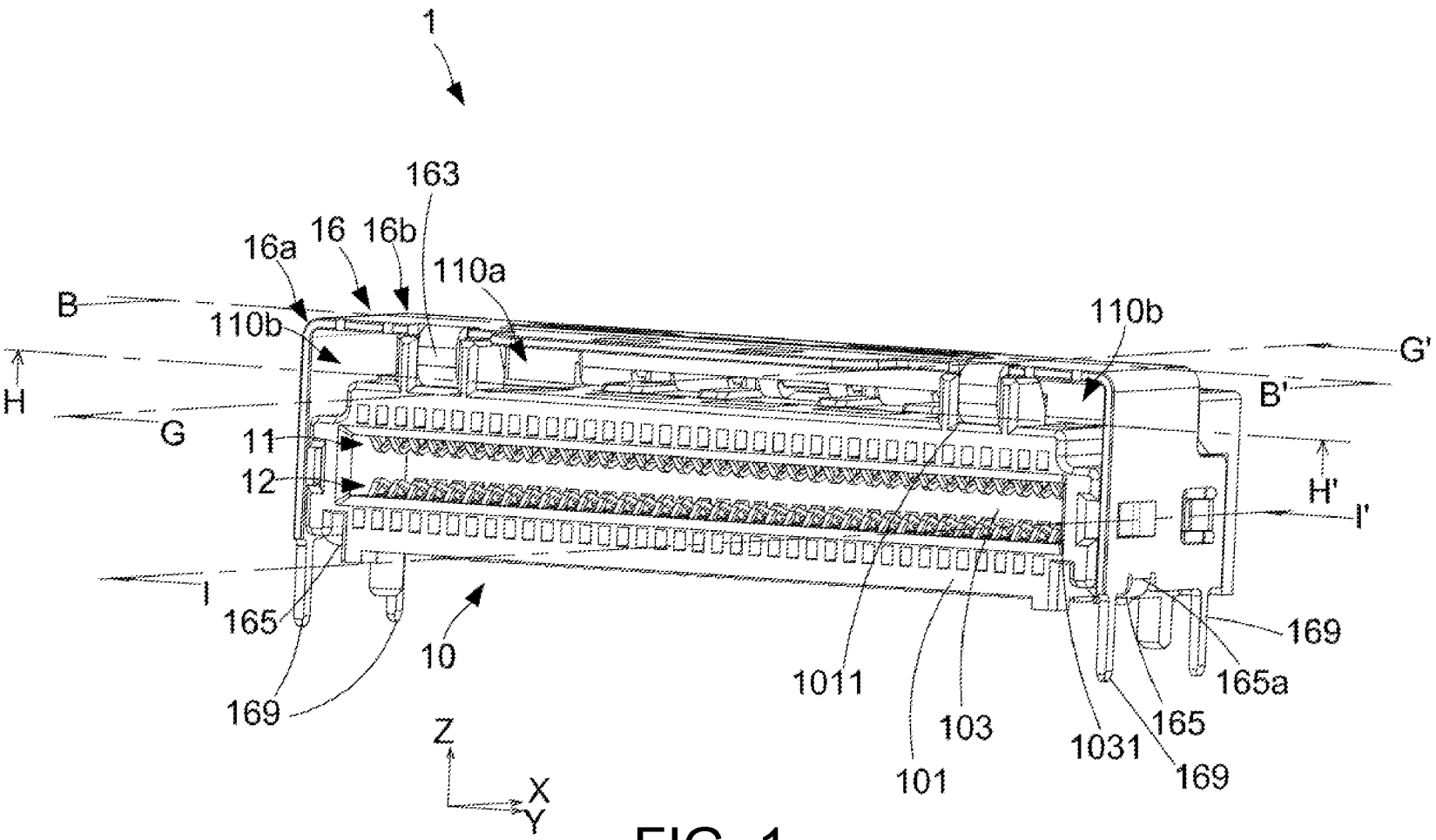
FIG. 1 is a perspective view of an electrical connector of the first embodiment of the present disclosure.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

The electrical connector of the present disclosure includes an insulating body, a first terminal module, a second terminal module, and an electromagnetic shielding component. The first terminal module and the second terminal module are disposed in the insulating body. The electromagnetic shielding component is disposed at the insulating body or/and at the first terminal module. The electromagnetic shielding component can be connected with a plurality of ground terminals of the first terminal module and a plurality of ground terminals of the second terminal module, so that the electromagnetic shielding component can electromagnetically shield the plurality of signal terminals of the first terminal module and the plurality of signal terminals of the second terminal module. Embodiments are provided below to illustrate the detailed configuration of the electrical connector for the present disclosure.

Figure 2:
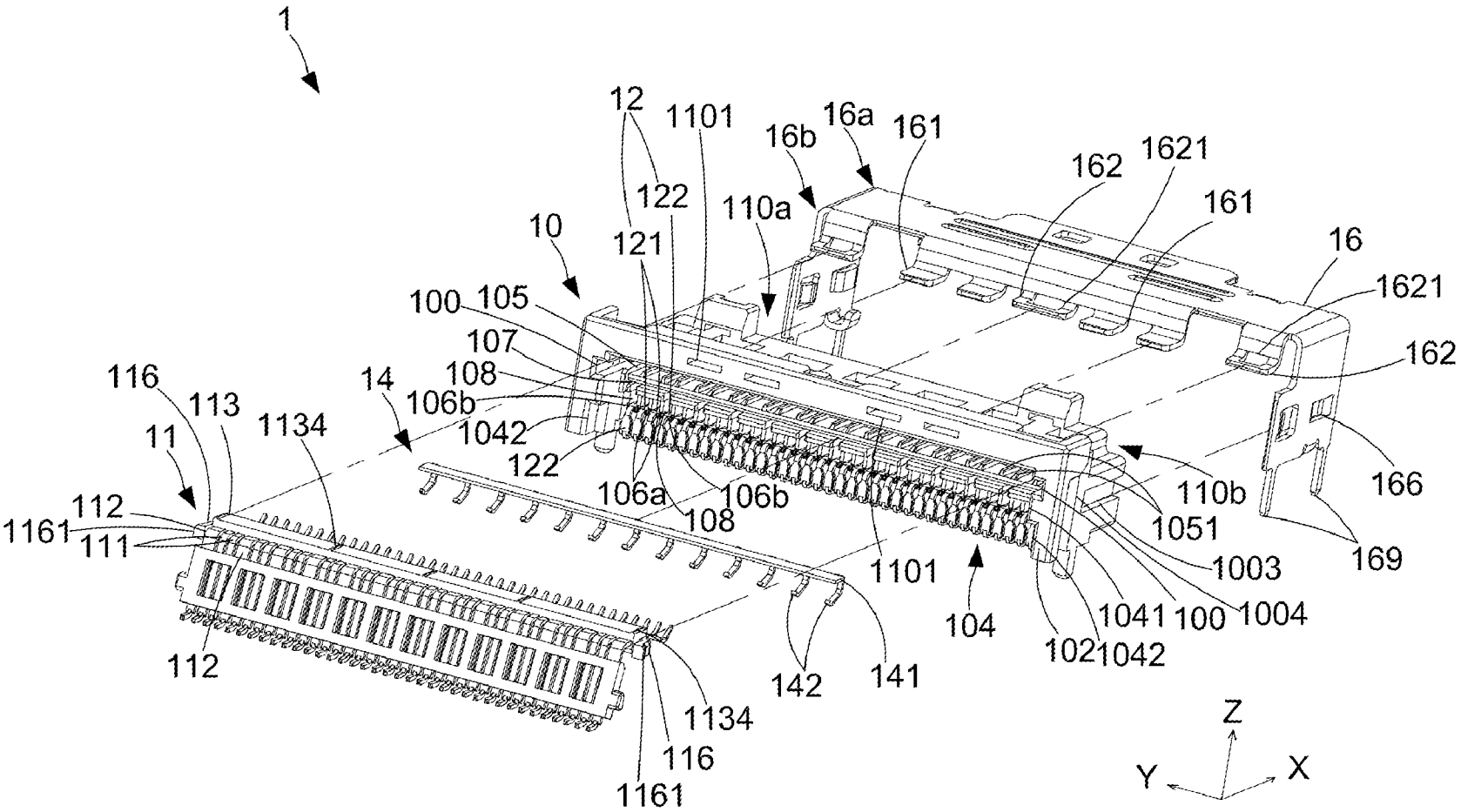
FIG. 2 is an exploded view of the electrical connector of the first embodiment of the present disclosure.
Figure 3:
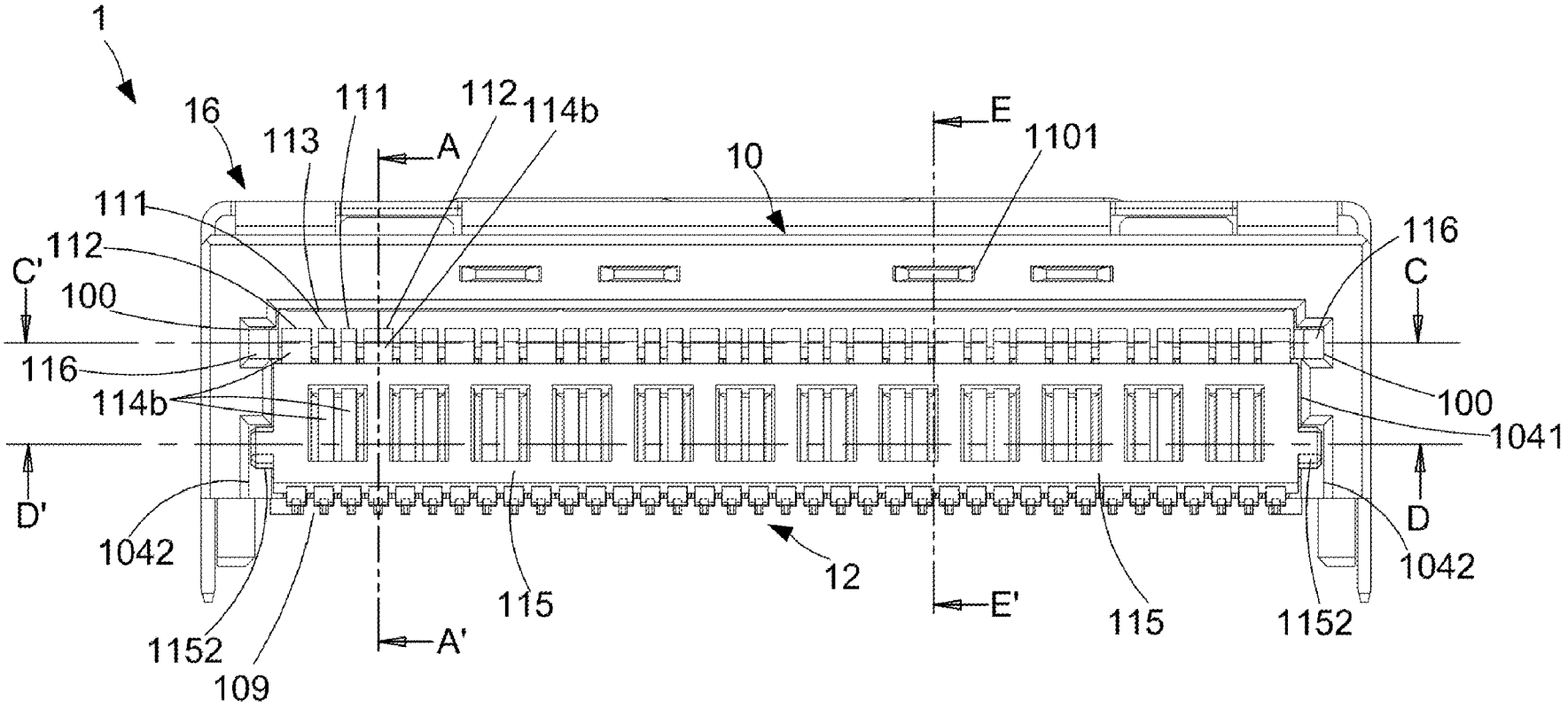
FIG. 3 is a rear view of the electrical connector of the first embodiment of the present disclosure.
Figure 4:
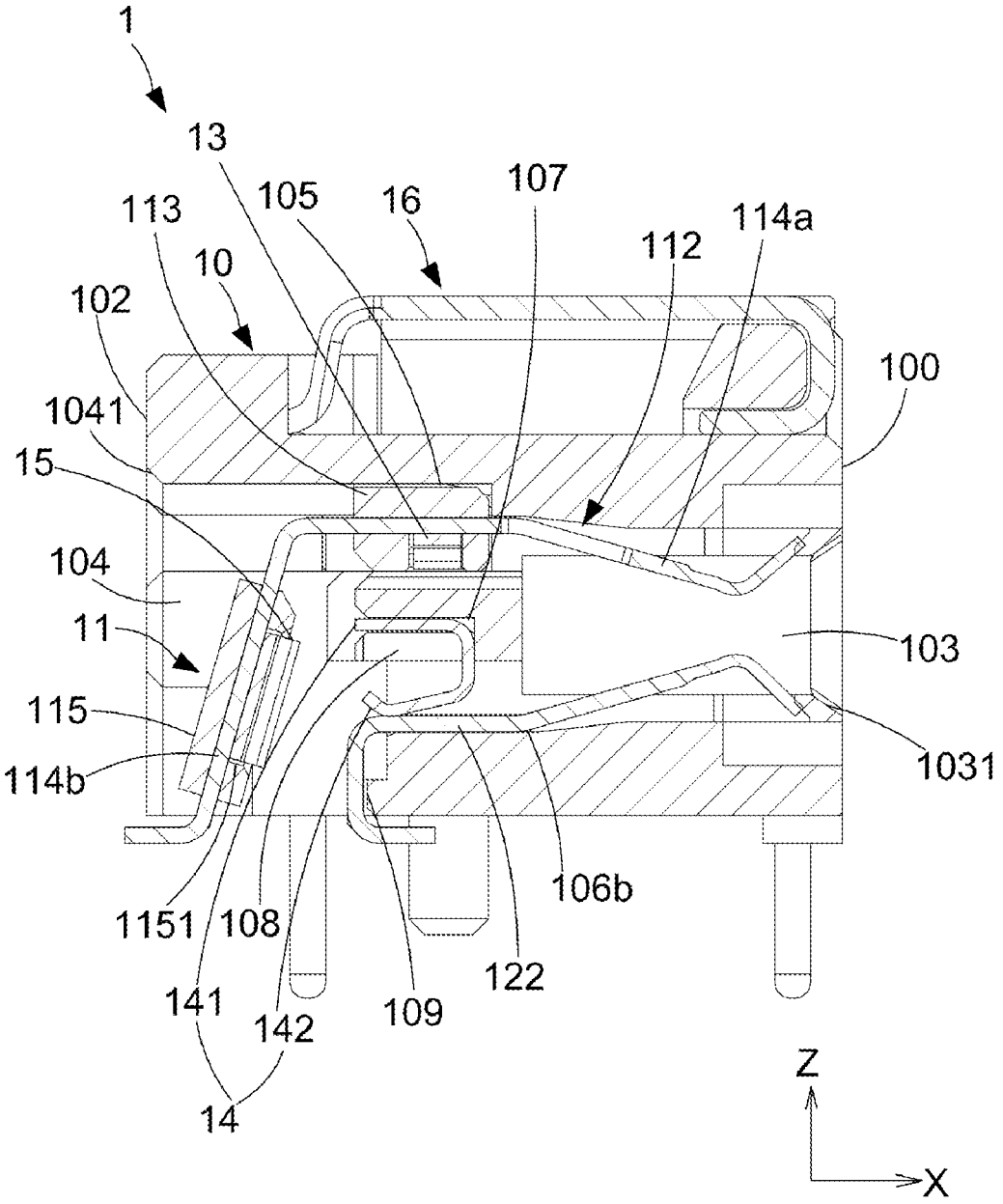
FIG. 4 is a cross-sectional view along line A-A' of FIG. 1.
Figure 5:
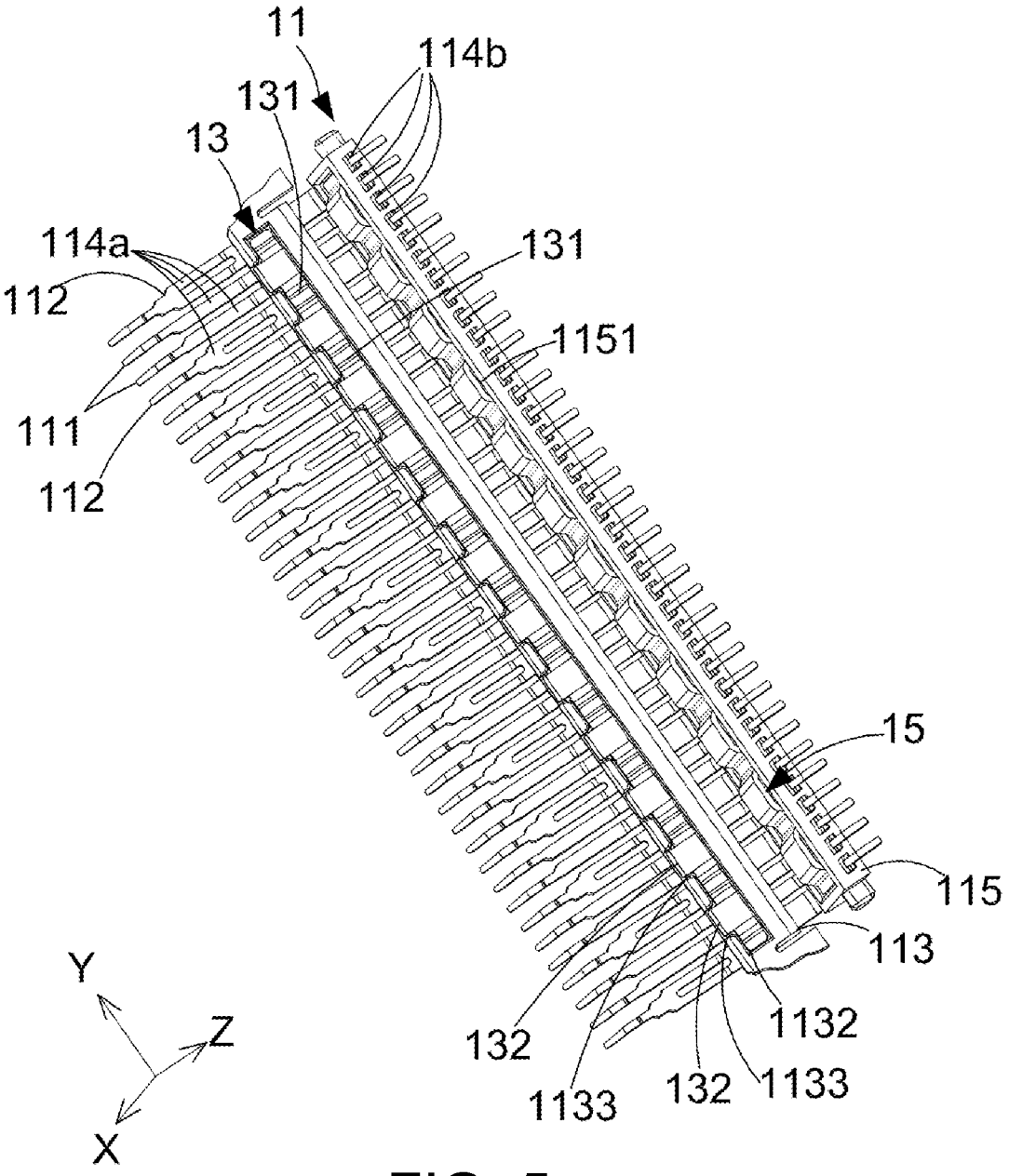
FIG. 5 is a perspective view of a first terminal module assembled with a first electromagnetic shielding member of the first embodiment of the present disclosure.

FIG. 1 to FIG. 3 are perspective view, exploded view, and rear view of an electrical connector of the first embodiment of the present disclosure. FIG. 4 is a cross-sectional view along line A-A' of FIG. 1. FIG. 5 is a perspective view of a first terminal module assembled with a first electromagnetic shielding member of the first embodiment of the present disclosure. As shown in the figures, in this embodiment, an electrical connector 1 comprises an insulating body 10, a first terminal module 11, a second terminal module 12, a first electromagnetic shielding member 13, and a second electromagnetic shielding member 14. The insulating body 10 comprises a first surface 101, a second surface 102, a first plugging slot 103, a second plugging slot 104, a terminal accommodating groove 105, a plurality of first terminal plugging slots 106*a*, a plurality of second terminal plugging slots 106*b*, a first electromagnetic shield accommodating groove 107, and a plurality of electromagnetic shield contacting grooves 108. The first surface 101 is opposite to the second surface 102 along the first direction X. The first plugging slot 103 is disposed on the first surface 101 and extends along the first direction X. The first plugging slot 103 forms a first opening 1031 on the first surface 101. The second plugging slot 104 is disposed on the second surface 102 and extends along the first direction X. The second plugging slot 104 forms a second opening 1041 on the second surface 102. The terminal accommodating groove 105 is disposed between the first plugging slot 103 and the second plugging slot 104. The terminal accommodating groove 105 extends along the first direction X and respectively communicates with the first plugging slot 103 and the second plugging slot 104.

The plurality of first terminal plugging slots 106*a* and the plurality of second terminal plugging slots 106*b* are disposed between the first plugging slot 103 and the second plugging slot 104 at intervals along a second direction Y orthogonal to the first direction X. The plurality of first terminal plugging slots 106*a* and the plurality of second terminal plugging slots 106*b* extend along the first direction X and respectively communicate with the first plugging slot 103 and the second plugging slot 104. The plurality of first terminal plugging slots 106*a* and the plurality of second terminal plugging slots 106*b* are disposed at one side of the terminal accommodating groove 105. In this embodiment, the plurality of first terminal plugging slots 106*a* and the plurality of second terminal plugging slots 106*b* are disposed on the lower side of the terminal accommodating groove 105. Two first terminal plugging slots 106*a* exists between two second terminal plugging slots 106*b*. A first electromagnetic shield accommodating groove 107 is disposed between the terminal accommodating groove 105, the plurality of first terminal plugging slots 106*a*, and the plurality of second terminal plugging slots 106*b* along the second direction Y. The first electromagnetic shield accommodating groove 107 extends along the first direction X and communicates with the second plugging slot 104. A plurality of electromagnetic shield contacting grooves 108 are disposed between the terminal accommodating groove 105, the plurality of first terminal plugging slots 106*a*, and the plurality of second plugging terminal slots 106*b* along the second direction Y at intervals. The plurality of electromagnetic shield contacting grooves 108 communicate with the second plugging slot 104. The plurality of electromagnetic shield contacting grooves 108 are respectively communicated with the first electromagnetic shield accommodating groove 107 and the plurality of second terminal plugging slots 106*b*.

Figure 6:
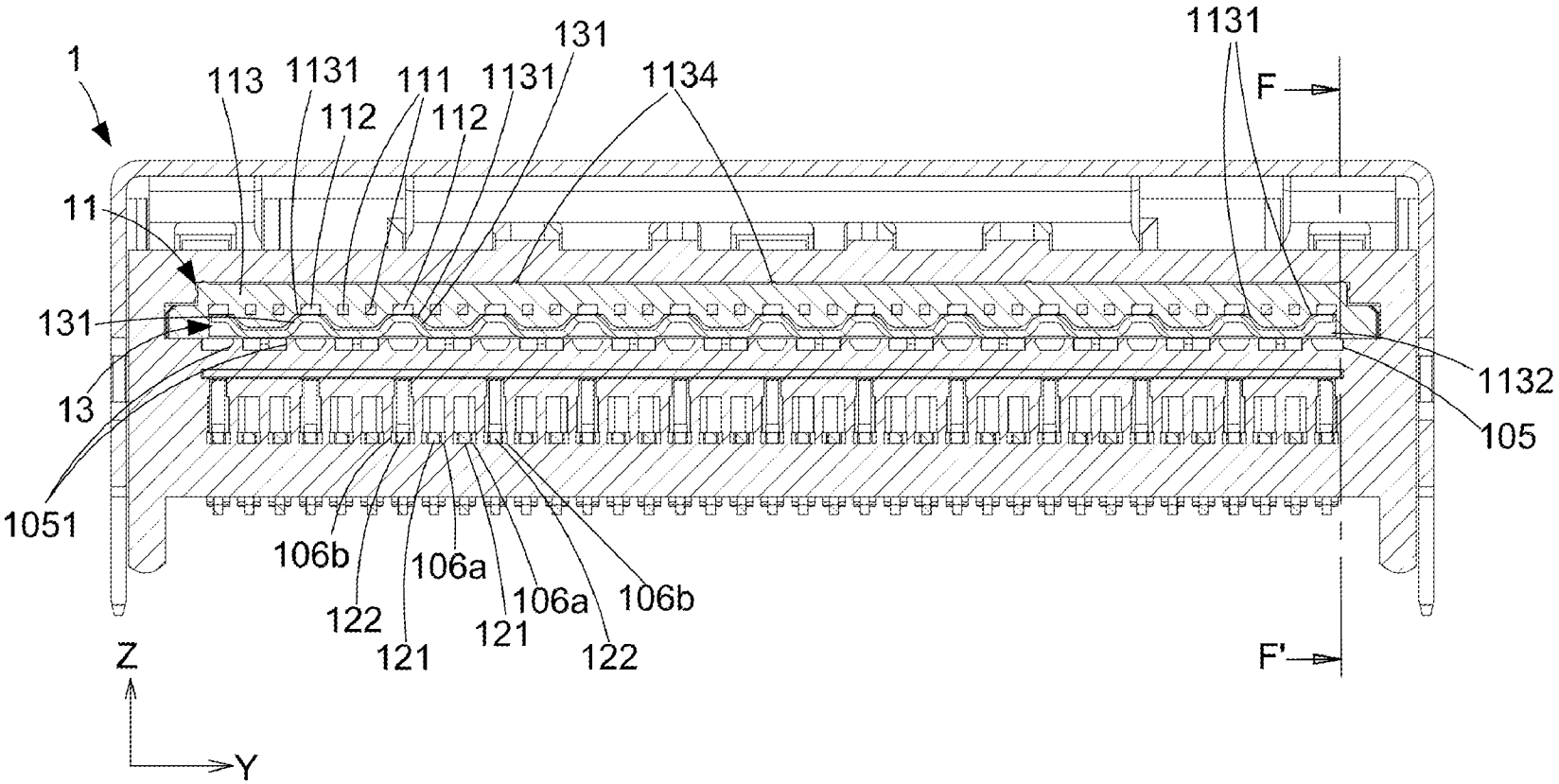
FIG. 6 is a cross-sectional view along line B-B' of FIG. 1.

As shown in FIG. 5, the first terminal module 11 comprises a plurality of first signal terminals 111, a plurality of first ground terminals 112, and a first terminal insulating body 113. The plurality of first signal terminals 111 and the plurality of first ground terminals 112 are disposed along the second direction Y at intervals. Two first signal terminals 111 exist between two first ground terminals 112. FIG. 6 is a cross-sectional view along line B-B' of FIG. 1. As shown in the figure, the first terminal insulating body 113 covers a part of the plurality of first signal terminals 111 and the plurality of first ground terminals 112. A surface of the first terminal insulating body 113 in a third direction Z comprises a plurality of first hollow parts 1131. The plurality of first ground terminals 112 are exposed from the first hollow parts 1131. Referring to FIG. 4, the first terminal insulating body 113 of the first terminal module 11 is disposed in the terminal accommodating groove 105. One ends of the plurality of first signal terminals 111 and one ends of the plurality of first ground terminals 112 enter the first plugging slot 103. The other ends of the plurality of first signal terminals 111 and the other ends of the plurality of first ground terminals 112 are disposed in the second plugging slot 104.

Referring to FIG. 2, FIG. 4, and FIG. 6, the second terminal module 12 comprises a plurality of second signal terminals 121 and a plurality of second ground terminals 122. The plurality of second signal terminals 121 are respectively assembled in the plurality of first terminal plugging slots 106*a*. One ends of the plurality of second signal terminals 121 enter the first plugging slot 103 through the plurality of first terminal plugging slots 106*a*. The other ends of the plurality of second signal terminals 121 are disposed in the second plugging slot 104. The plurality of second ground terminals 122 are respectively assembled in the plurality of second terminal plugging slots 106*b*. One ends of the plurality of second ground terminals 122 enter the first plugging slot 103 through the plurality of second terminal plugging slots 106*b*. The other ends of the plurality of second signal terminals 121 are disposed in the second plugging slot 104.

Referring to FIG. 4, FIG. 5, and FIG. 6, the first electromagnetic shielding member 13 is disposed at the first terminal insulating body 113 and is in contact with the plurality of first ground terminals 112. The first electromagnetic shielding member 13 comprises a plurality of first contacting bumps 131 disposed at intervals. The plurality of first contacting bumps 131 extend along the third direction Z orthogonal to the first direction X and the second direction Y. The plurality of first contacting bumps 131 respectively enter the plurality of first hollow parts 1131. The plurality of first contacting bumps 131 are respectively in contact with the plurality of first ground terminals 112. The first electromagnetic shielding member 13 disposed at the two first contacting bumps 131 is in contact with the first terminal insulating body 113 disposed between the two first hollow parts 1131. In this way, the first electromagnetic shielding member 13 could electromagnetically shield the plurality of first signal terminals 111. Since the shape of the cross-sectional area of the first hollow part 1131 of this embodiment is identical to the shape of the cross-sectional area of the first contacting bump 131, the plurality of first contacting bumps 131 of the first electromagnetic shielding member 13 can be stably engaged with the plurality of first hollow parts 1131, respectively, which also indicates that the first electromagnetic shielding member 13 can be directly assembled to the first terminal insulating body 113. The first electromagnetic shielding member 13 of this embodiment is wave-shaped.

In this embodiment, a surface of the first terminal insulating body 113 in the third direction Z comprises a first retaining part 1132. The plurality of first hollow parts 1131 are disposed in the first retaining part 1132. The first retaining part 1132 communicates with the plurality of first hollow parts 1131. The first electromagnetic shielding member 13 is disposed in the first retaining part 1132. In this way, the first electromagnetic shielding member 13 does not protrude from the surface of the first terminal insulating body 113 in the third direction Z. In this embodiment, the first electromagnetic shielding member 13 further comprises a plurality of first positioning bumps 132 respectively disposed between two adjacent first contacting bumps 131. The plurality of first positioning bumps 132 extend along the first direction X. The surface of the first terminal insulating body 113 on the third direction Z further comprises a plurality of positioning recesses 1133. The plurality of positioning recesses 1133 are respectively disposed between two adjacent first hollow parts 1131 and communicate with the first retaining part 1132. The plurality of first positioning bumps 132 are respectively disposed in the plurality of positioning recesses 1133 to locate the position of the first electromagnetic shielding member 13 in the first recess 1132. In this way, the plurality of first contacting bumps 131 can be accurately disposed in the plurality of first hollow parts 1131, respectively.

Referring to FIG. 2, FIG. 4, the second electromagnetic shielding member 14 comprises an electromagnetic shielding body 141 and a plurality of lower contacting elastic pieces 142. The plurality of lower contacting elastic pieces 142 are disposed at one side of the electromagnetic shielding body 141 along the second direction Y at intervals. The electromagnetic shielding body 141 is disposed in the first electromagnetic shield accommodating groove 107. The plurality of lower contacting elastic pieces 142 are respectively disposed in the plurality of electromagnetic shield contacting grooves 108. The plurality of lower contacting elastic pieces 142 are respectively in contact with the plurality of second ground terminals 122 disposed in the plurality of electromagnetic shield contacting grooves 108. In this way, the second electromagnetic shielding member 14 could electromagnetically shield the plurality of second signal terminals 121. In this embodiment, the second electromagnetic shielding member 14 is also directly assembled to the insulating body 10. Thus, in this embodiment, the first electromagnetic shielding member 13 and the second electromagnetic shielding member 14 electromagnetically shield the plurality of first signal terminals 111 of the first terminal module 11 and the plurality of second signal terminals 121 of the second terminal module 12, respectively.

In this embodiment, the electrical connector 1 is a horizontal type electrical connector. The plurality of first signal terminals 111, the plurality of first ground terminals 112, the plurality of second signal terminals 121, and the plurality of second ground terminals 122 are all presented in a bent shape. Referring to FIG. 3, FIG. 4, and FIG. 5, a bottom surface of the insulating body 10 further comprises a notch 109, which communicates with the second plugging slot 104. The plurality of first signal terminals 111, the plurality of first ground terminals 112, the plurality of second signal terminals 121, and a plurality of second ground terminals 122 in the second plugging slot 104 pass through the notch 109. In this embodiment, the plurality of first signal terminals 111 and the plurality of first ground terminals 112 respectively comprise a first end part 114*a* and a second end part 114*b*. The first end part 114*a* and the second end part 114 form an angle. The angle is smaller than 180 degrees. The first end part 114*a* extends in the first direction X, and the second end part 114*b* extends in the third direction Z. The first terminal insulating body 113 is disposed at the first end parts 114*a* of the plurality of first signal terminals 111 and the first end parts 114*a* of the plurality of first ground terminals 112. In this embodiment, the first terminal module 11 further comprises a second terminal insulating body 115 disposed at the second end parts 114*b* of the plurality of first signal terminals 111 and the second end parts 114*b* of the plurality of first ground terminals 112. A surface of the second terminal insulating body 115 in the first direction X further comprises a second hollow part 1151. The plurality of first signal terminals 111 and the plurality of first ground terminals 112 are exposed from the second hollow part 1151. The electrical connector 1 further comprises a third electromagnetic shielding member 15 which can be disposed in the second hollow part 1151. The third electromagnetic shielding member 15 is in contact with the plurality of first ground terminals 112 so that the third electromagnetic shielding member 15 could electromagnetically shield the plurality of first signal terminals 111. The configurational structure of the third electromagnetic shielding member 15 is identical to that of the first electromagnetic shielding member 13, which would not be repeated herein.

Referring to FIG. 2 and FIG. 6, in this embodiment, a surface of the terminal accommodating groove 105 in the third direction Z and close to the bottom surface of the insulating body 10 further comprises a plurality of first ribs 1051 disposed at intervals. When the first terminal insulating body 113 is disposed in the terminal accommodating groove 105, the plurality of first ribs 1051 would support the first terminal insulating body 113 to reduce the area size that the surface of the first terminal insulating body 113 in the third direction Z and close to the bottom surface of the insulating body 10 contacting with the surface of the terminal accommodating groove 105 in the third direction Z and close to the bottom surface of the insulating body 10. In this way, the first terminal insulating body 113 can be easily installed in the terminal accommodating groove 105.

In this embodiment, a surface of the first terminal insulating body 113 in the third direction Z and away from the bottom surface of the insulating body 10 further comprises a plurality of second ribs 1134 disposed at intervals. When the first terminal insulating body 113 is disposed in the terminal accommodating groove 105, the plurality of second ribs 1134 would be in contact with a surface of the terminal accommodating groove 105 in the third direction Z and away from the bottom surface of the insulating body 10 to reduce the area size that the surface of the first terminal insulating body 113 in the third direction Z and away from the bottom surface of the insulating body 10 contacting with the surface of the terminal accommodating groove 105 in the third direction Z and away from the bottom surface of the insulating body 10. In this way, the first terminal insulating body 113 can be easily installed in the terminal accommodating groove 105.

Figure 7:
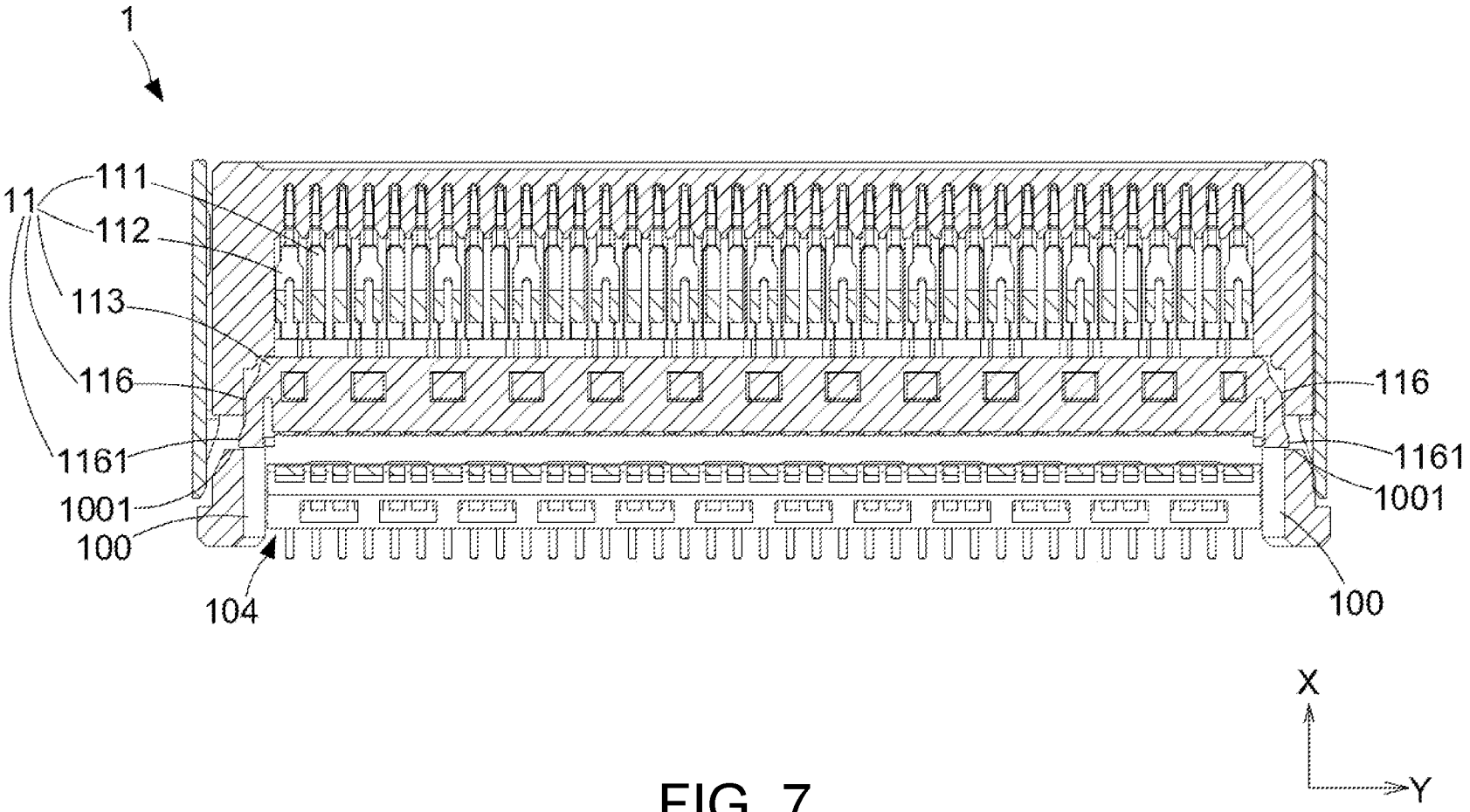
FIG. 7 is a cross-sectional view along line C-C' of FIG. 3.

Referring to FIG. 2, FIG. 3, and also FIG. 7, a cross-sectional view along line C-C' of FIG. 3. In this embodiment, two opposite sides of the first terminal insulating body 113 in the second direction Y are respectively provided with an elastic arm 116. One end of the elastic arm 116 is disposed at the first terminal insulating body 113. The elastic arm 116 extends in a direction away from one ends of the plurality of first signal terminals 111 and one ends of the plurality of first ground terminals 112 and extends along the first direction X. The other end of the elastic arm 116 is a movable end. A gap exists between the elastic arm 116 and the first terminal insulating body 113. The other end of the elastic arm 116 is provided with a buckling bump 1161. The buckling bump 1161 extends in a direction away from the first terminal insulating body 113 along the second direction Y. Two opposite inner surfaces of the insulating body 10 in the second direction Y respectively comprises a guiding groove 100, and the guiding groove 100 extends from the second surface 102 to the terminal accommodating groove 105 along the first direction X, which indicates that the guiding groove 100 is disposed on an inner surface of the second plugging slot 104 and an inner surface of the terminal accommodating groove 105 in the second direction Y. An inner surface of the guiding groove 100 in the second direction Y comprises a buckling through hole 1001. When the first terminal insulating body 113 is moved into the terminal accommodating groove 105 from the second plugging slot 104, the two elastic arms 116 would respectively enter the terminal accommodating groove 105 along the corresponding guiding groove 100. The buckling bump 1161 of the elastic arm 116 is disposed in the buckling through hole 1001. A surface of the buckling bump 1161 in the first direction X and close to the second plugging slot 104 abuts against a sidewall of the buckling through hole 1001 in the first direction X and close to the second plugging slot 104. In this way, the first terminal insulating body 113 can be prevented from being detached from the second plugging slot 104, thereby further preventing the first terminal module 11 from being detached from the second plugging slot 104.

Figure 8:
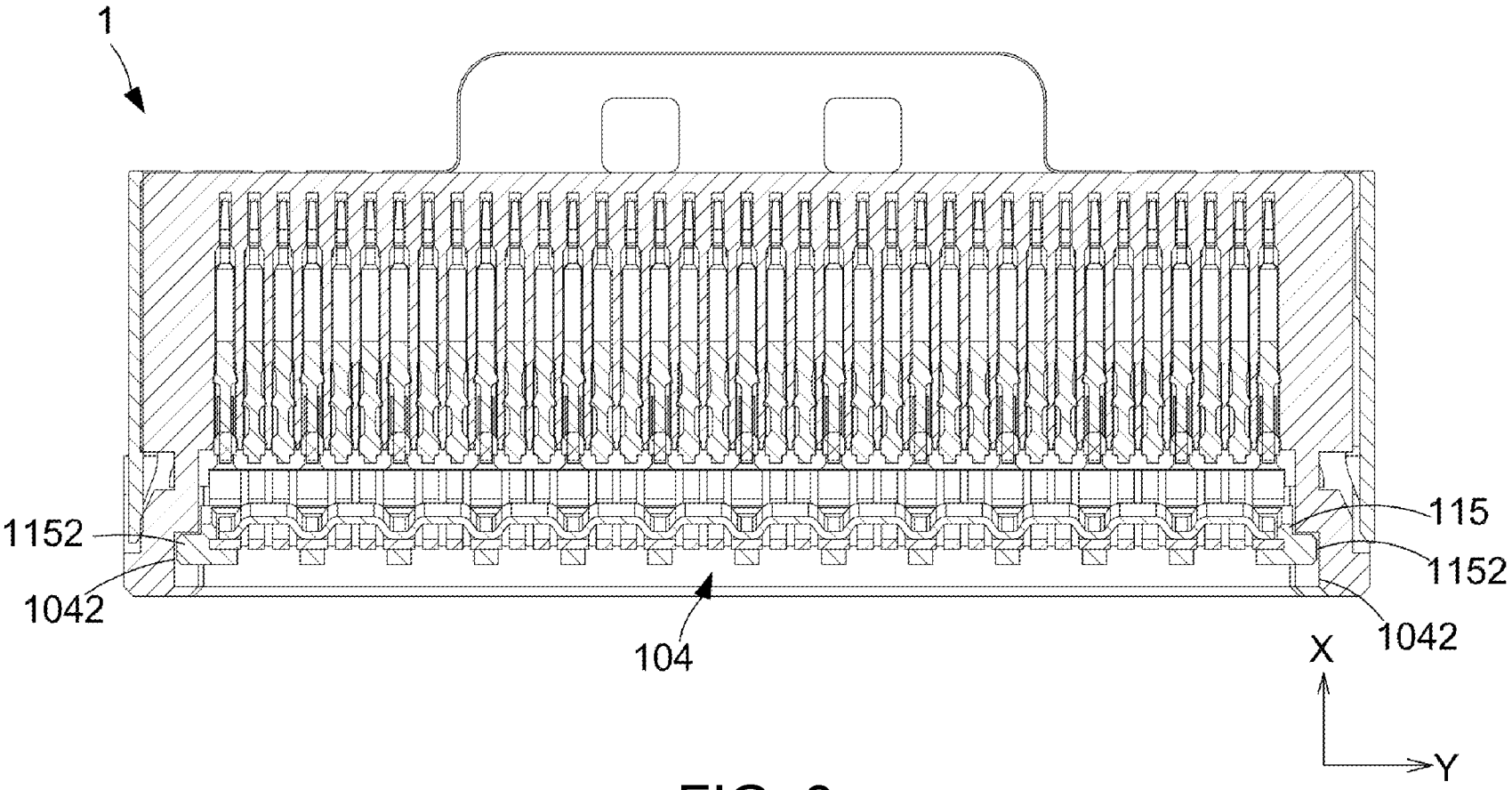
FIG. 8 is a cross-sectional view along line D-D' of FIG. 3.

Referring to FIG. 2, FIG. 3, and also FIG. 8, a cross-sectional view along line D-D' of FIG. 3. In this embodiment, two opposite sidewalls of the second plugging slot 104 in the second direction Y respectively comprise a limiting groove 1042. Two opposite sides of the second terminal insulating body 115 in the second direction Y are provided with a limiting bump 1152. When the second terminal insulating body 115 is disposed in the second plugging slot 104, the limiting bump 1152 would be disposed in the corresponding limiting groove 1042. A surface of the limiting bump 1152 in the third direction Z and away from the bottom surface of the insulating body 10 limits a surface of the limiting groove 1042 in the third direction Z and away from the bottom surface of the insulating body 10. In this way, the location of the second terminal insulating body 115 in the second plugging slot 104 can be positioned.

Referring to FIG. 1, FIG. 2, FIG. 3, and FIG. 4, in this embodiment, the electrical connector 1 further comprises a housing 16 disposed at one side of the insulating body 10. The housing 16 covers a top surface of the insulating body 10 and two opposite side surfaces in the second direction Y. The bottom surface of the insulating body 10 is exposed from the housing 16. The top surface of the insulating body 10 comprises a first positioning notch 110*a* and two second positioning notches 110*b*. The two second positioning notches 110*b* are disposed at two sides of the first positioning notch 110*a*. The two second positioning notches 110*b* are respectively communicated with the first positioning notch 110*a*. The first positioning notch 110*a* and the two second positioning notches 110*b* form a plurality of positioning parts with the housing 16. The two second positioning notches 110*b* are in an inverted L-type shape. The two second positioning notches 110*b* respectively form an inverted L-shaped positioning part with the housing 16. The plurality of positioning parts are configured to be connected with a mating connector so that the mating connector and the electrical connector 1 can be accurately connected.

Figure 9:
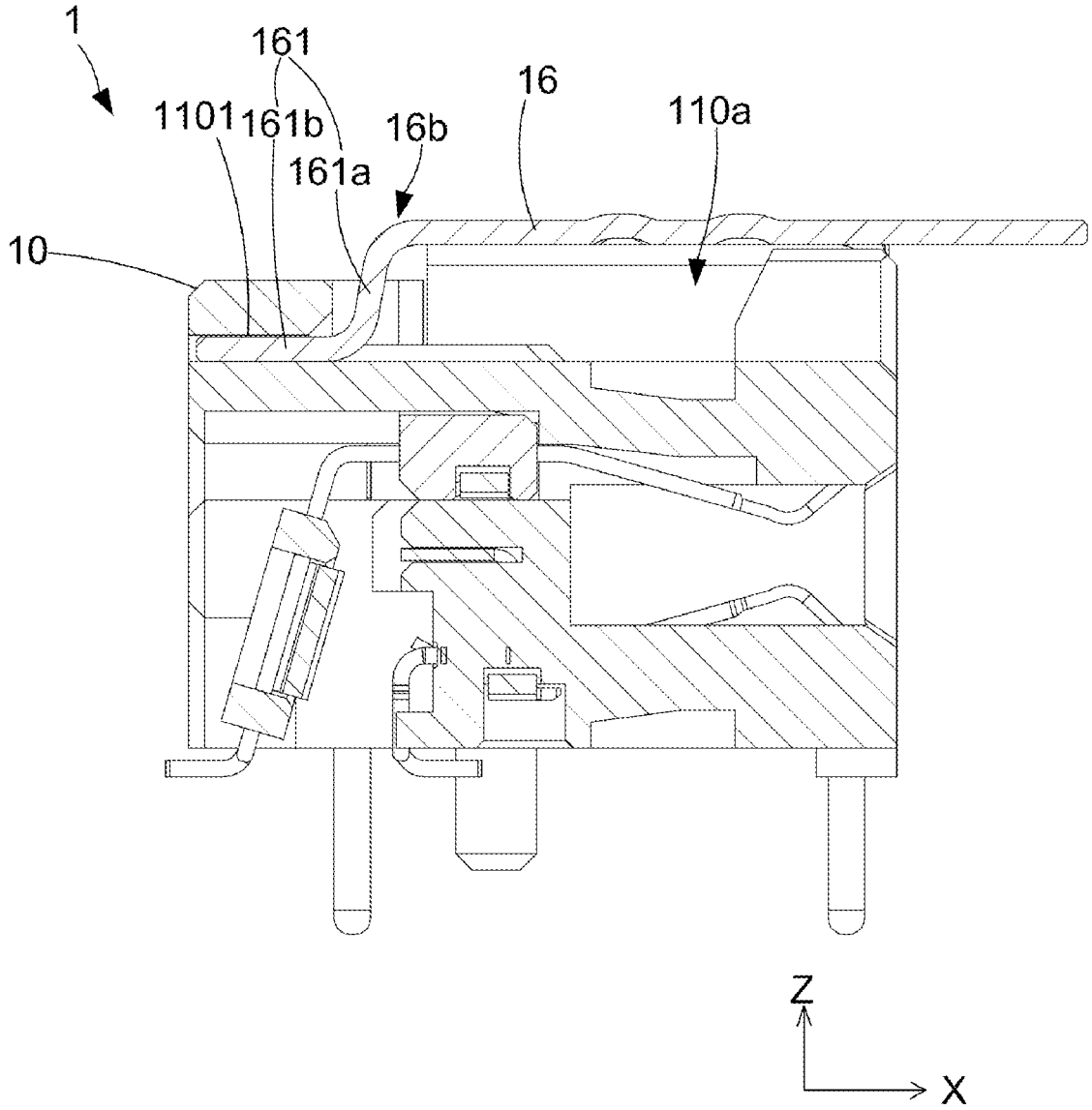
FIG. 9 is a cross-sectional view along line E-E' of FIG. 3.

The housing 16 comprises a first side 16*a* and a second side 16*b* opposite to the first side 16*a*. The first side 16*a* corresponds to the first pugging slot 103 of the insulating body 10, and the second side 16*b* corresponds to the second plugging slot 104 of the insulating body 10. FIG. 9 is a cross-sectional view along line E-E' of FIG. 3. As shown in the figure, a top surface of the housing 16 in the first direction X and close to the second side 16*b* further comprises a plurality of positioning pieces 161. A sidewall of the first positioning notch 110*a* in the first direction X close to the second surface 102 further comprises a plurality of positioning plug holes 1101 arranged at intervals. The plurality of positioning plug holes 1101 extend along the first direction. When the housing 16 is disposed at one side of the insulating body 10, the plurality of positioning pieces 161 would be respectively inserted into the plurality of positioning plug holes 1101 to locate the position of the housing 16 relative to the insulating body 10. In this embodiment, the positioning piece 161 is L-shaped and comprises a first positioning piece body 161*a* and a second positioning piece body 161*b* connected with the first positioning piece body 161*a*. The first positioning piece 161*a* extends along the third direction Z. One end of the first positioning piece 161*a* away from the second positioning piece 161*b* is connected with the top surface of the housing 16. The second positioning piece 161*b* extends along the first direction X. The first positioning piece 161*a* enables the second positioning piece 161*b* to go deep into the first positioning notch 110*a*. The second positioning piece 161*b* is inserted into the positioning plug hole 1101.

Figure 10:
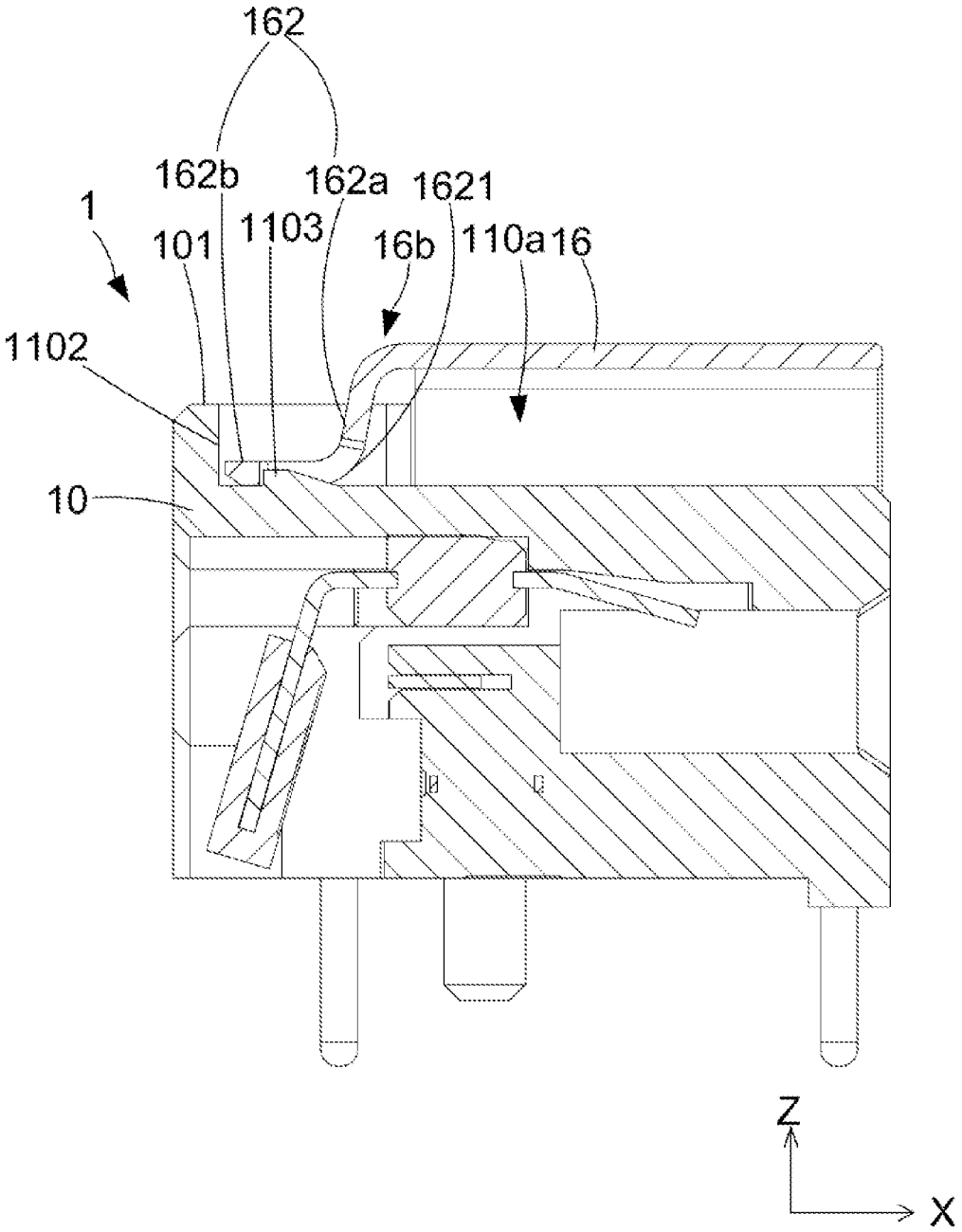
FIG. 10 is a cross-sectional view along line F-F' of FIG. 6.

FIG. 10 is a cross-sectional view along line F-F' of FIG. 6. In this embodiment, as shown in the figure, a side edge of the top surface of the housing 16 in the first direction X and close to the second side 16*b* further comprises a plurality of first buckling pieces 162. The plurality of first buckling pieces 162 comprise a buckling hole 1621. The top surface of the insulating body 10 further comprises a plurality of first buckling grooves 1102 and a plurality of buckling blocks 1103 disposed at intervals. The plurality of first buckling grooves 1102 extend along the third direction Z and communicate with the first positioning notch 110*a*. The plurality of buckling blocks 1103 are respectively disposed on a surface of the plurality of first buckling grooves 1102 in the third direction Z. When the housing 16 is disposed at one side of the insulating body 10, the plurality of first buckling pieces 162 would be respectively disposed in the plurality of first buckling grooves 1102. The plurality of buckling blocks 1103 are respectively disposed in the buckling holes 1621 of the plurality of first buckling pieces 162. The buckling block 1103 limits the first buckling piece 162 only to move in the first direction X and the second direction Y to secure the housing 16 on the insulating body 10. In this embodiment, the first buckling piece 162 is L-shaped. The first buckling piece 162 comprises a first buckling piece body 162*a* and a second buckling piece body 162*b* connected with the first buckling piece body 162*a*. The first buckling piece body 162*a* extends along the third direction Z. One end of the first buckling piece body 162*a* away from the second buckling piece body 162*b* is connected with the top surface of the housing 16. The second buckling piece body 162*b* extends along the first direction X. The buckling hole 1621 is disposed on the second buckling piece body 162*b*. The first buckling piece body 162*a* enables the second buckling piece body 162*b* to be inserted into the first positioning notch 110*a*. The second buckling piece body 162*b* is disposed in the first buckling groove 1102. The buckling block 1103 is disposed in the buckling hole 1621.

Figure 11:
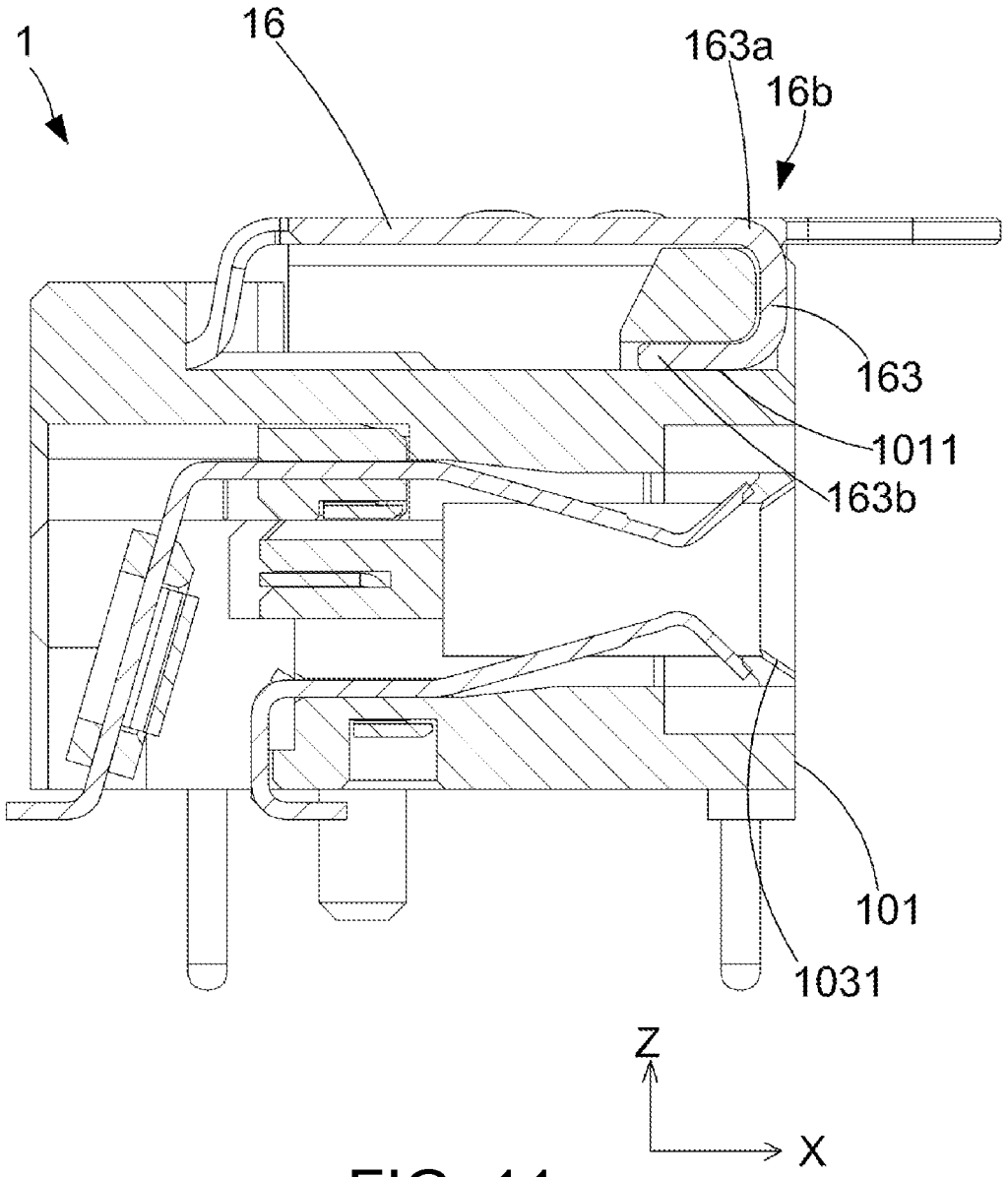
FIG. 11 is a cross-sectional view along line G-G' of FIG. 1.
Figure 12:
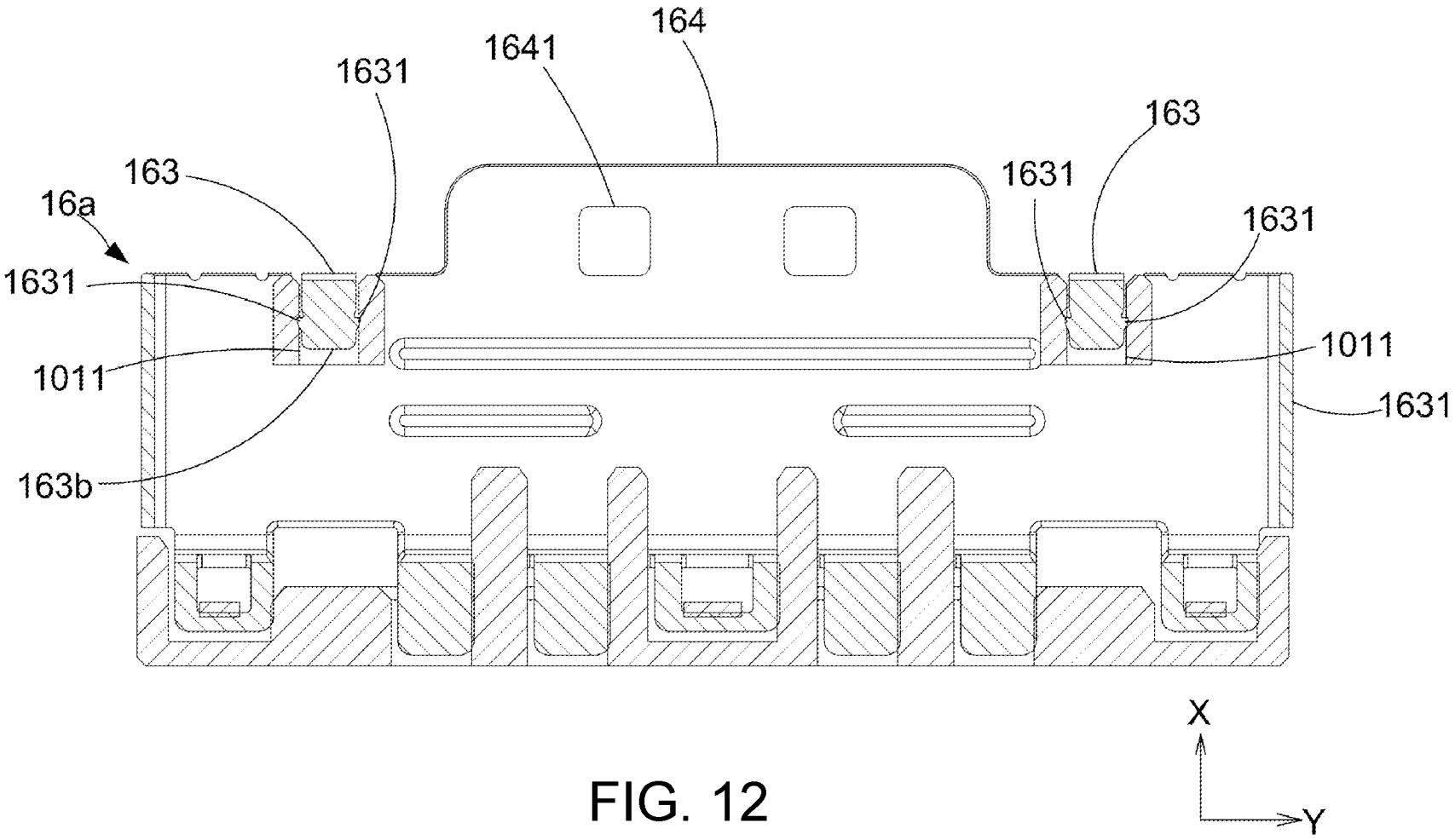
FIG. 12 is a cross-sectional view along line H-H' of FIG. 1.

FIG. 11 is a cross-sectional view along line G-G' of FIG. 1. FIG. 12 is a cross-sectional view along line H-H' of FIG. 1. In this embodiment, as shown in the figures, a side edge of the top surface of the housing 16 in the first direction X and close to the first side 16*a* further comprises two second buckling pieces 163. The two second buckling pieces 163 are inverted C-shaped or U-shaped, and respectively comprise a first connecting end 163*a* and a buckling end 163*b*. The first connecting end 163*a* is disposed on a side edge of the top surface of the housing 16 in the first direction X and close to the first side 16*a*. The buckling end 163*b* is disposed in the housing 16. The first surface 101 of the insulating body 10 further comprises two second buckling grooves 1011. The two second buckling grooves 1011 are respectively disposed between the first positioning notch 110*a* and the second positioning notch 110*b*. The two second buckling grooves 1011 respectively extend along the first direction X. When the housing 16 is disposed at one side of the insulating body 10, the buckling ends 163*b* of the two second buckling pieces 163 would be respectively inserted into the two second buckling grooves 1011, and the two second buckling pieces 163 would abut against the first surface 101 of the insulating body 10. In this way, the housing 16 can be prevented from being detached from the insulating body 10 in a direction away from the first opening 1031. In this embodiment, two opposite sides of the second buckling piece 163 further comprise an interfering part 1631, respectively. The interfering part 1631 is close to the buckling end 163*b* and interferes with a sidewall of the second buckling groove 1011 so that the second buckling piece 163 would not be easily detached from the second buckling groove 1011.

In this embodiment, the side edge of the top surface of the housing 16 in the first direction X and close to the first side 16*a* further comprises a latching tab 164 disposed between the two second buckling pieces 163. The latching tab 164 protrudes from a side edge of the top surface of the housing 16 in the first direction X and close to the first side 16*a* along the first direction X. The latching tab 164 is configured to be connected with the mating connector to secure the electrical connector 1 to the mating connector. In this embodiment, the latching tab 164 further comprises two latching holes 1641.

Figure 13:
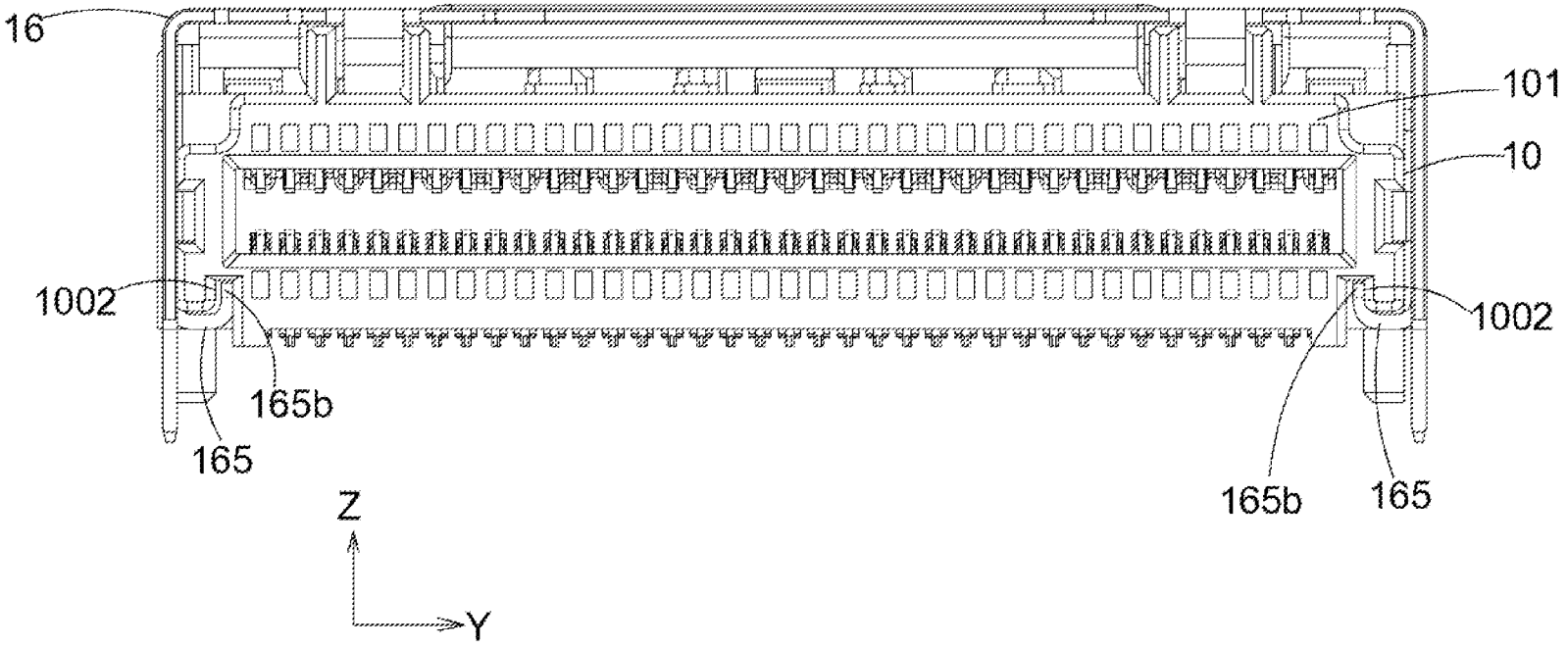
FIG. 13 is a front view of the electrical connector of the first embodiment of the present disclosure.

Referring to FIG. 1, and FIG. 13, a front view of the electrical connector of the first embodiment of the present disclosure, in this embodiment, the bottom surface of the insulating body 10 further comprises two limiting recesses 1002 respectively close to two side surfaces of the housing 16. The two limiting recesses 1002 extend along the first direction X from the first surface 101 of the insulating body 10 to the second surface 102 of the insulating body 10. Side edges of the two side surfaces of the housing 16 in the third direction Z and away from the top surface of the housing 16 further comprise a limiting piece 165. In this embodiment, the limiting piece 165 is U-shaped or C-shaped, and comprises a second connecting end 165*a* and a limiting end 165*b*. The second connecting end 165*a* is disposed at side edges of the two side surfaces of the housing 16 in the third direction Z and away from the top surface of the housing 16. The limiting end 165*b* is disposed in the housing 16. When the housing 16 is disposed at one side of the insulating body 10, the limiting end 165*b* of the limiting piece 165 would be disposed in the limiting recess 1002. The limiting end 165*b* of the limiting piece 165 abuts against a sidewall of the limiting recess 1002 in the first direction X to prevent the housing 16 from detaching along the first direction X, towarding the first surface 101. Meanwhile, the limiting piece 165 abuts against the bottom surface of the insulating body 10 to prevent the housing 16 from detaching along the third direction Z, away from the top surface of the insulating body 10.

Figure 14:
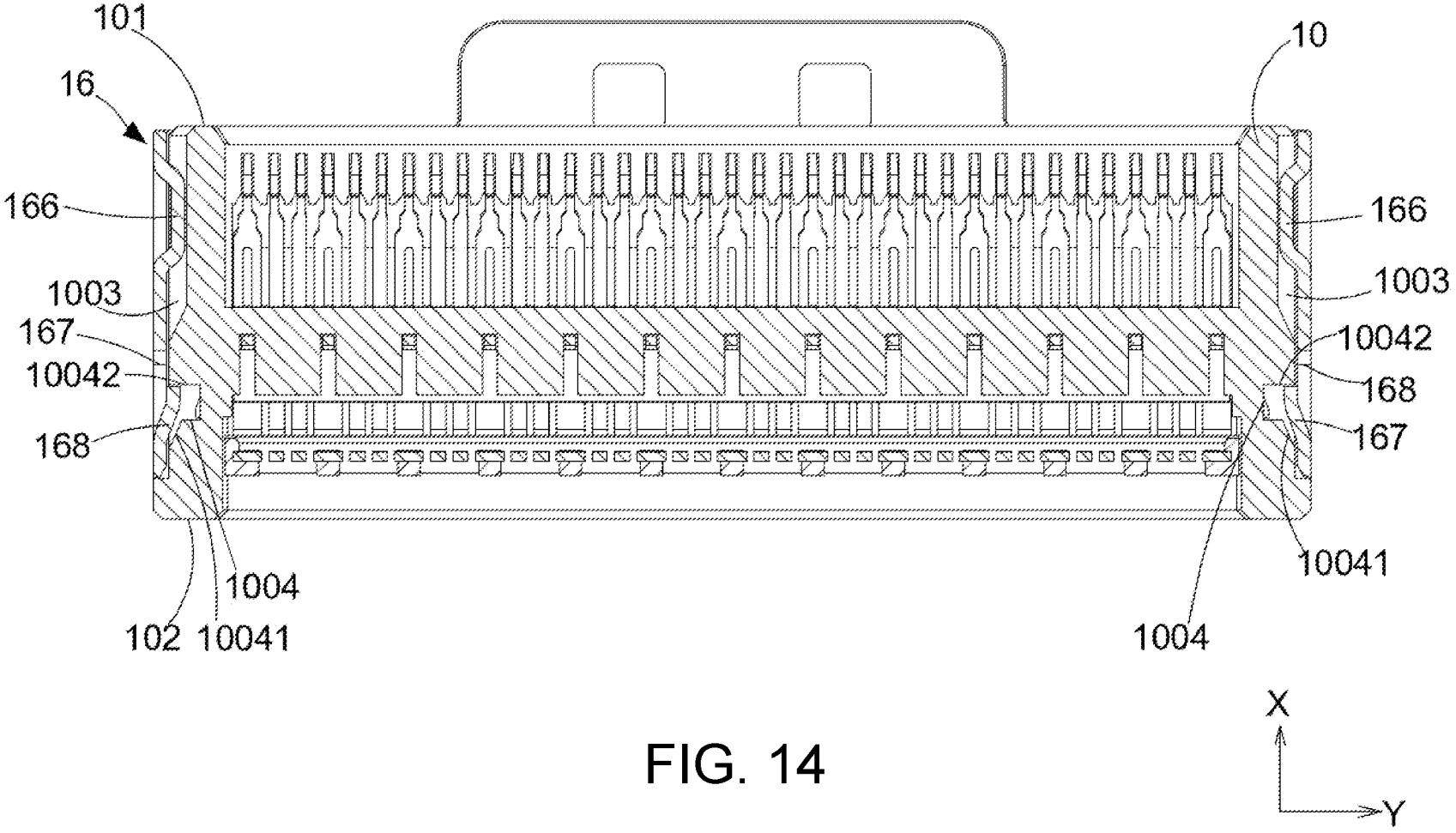
FIG. 14 is a cross-sectional view along line I-I' of FIG. 1.

Referring to FIG. 1, FIG. 2, and FIG. 14, a cross-sectional view along line I-I' of FIG. 1. In this embodiment, two opposite side surfaces of the insulating body 10 in the second direction Y further comprises a guiding recess 1003, respectively. The guiding recess 1003 extends from the first surface 101 of the insulating body 10 to the second surface 102 of the insulating body 10 along the first direction X. Two side surfaces of the housing 16 further comprise a guiding bump 166, respectively. The guiding bump 166 protrude in a direction toward the inner side of the housing 16. In this embodiment, when the housing 16 is disposed at one side of the insulating body 10, the guiding bump 166 would move along the guiding recess 1003 to drive the housing 16 to move to a predetermined position. A surface of the guiding bump 166 in the first direction X and close to the second surface 102 limits the surface of the guiding groove 1003 in the first direction X and close to the second surface 102 to prevent the housing 16 from detaching along the first direction X and along the direction close to the first surface 101.

In this embodiment, two opposite side surfaces of the insulating body 10 in the second direction Y respectively comprise a positioning groove 1004. The positioning groove 1004 is closer than the guiding recess 1003 to the second surface 102. The positioning groove 1004 extends from the bottom surface of the insulating body 10 to the top surface of the insulating body 10 along the third direction Z. The positioning groove 1004 further comprises an abutting inclined surface 10041 and a limiting surface 10042 in the first direction X. The limiting surface 10042 is farther than the abutting inclined surface 10041 away from the second surface 102. Two side surfaces of the housing 16 further comprise a retaining hole 167 and a limiting elastic piece 168, respectively. One end of the limiting elastic piece 168 is connected with a side edge of the retaining hole 167 in the first direction X and close to the second surface 102. The limiting elastic piece 168 extends along the first direction X. The other end of the limiting elastic piece 168 can move in the retaining hole 167. The limiting elastic piece 168 is inclined toward the inside of the housing 16 relative to a side surface of the housing 16. When the housing 16 of this embodiment is disposed at one side of the insulating body 10, the limiting elastic piece 168 would abut against the abutting inclined surface 10041. The other end of the limiting elastic piece 168 corresponds to the limiting surface 10042. The elastic force of the two limiting elastic pieces 168 in the second direction Y is applied to clamp the insulating body 10 to limit the insulating body 10 to only move in the second direction Y. Besides, the limiting surface 10042 limits the limiting elastic piece 168 to only move in the first direction X and in the direction close to the first surface 101. In this way, the housing 16 can be prevented from detaching from the insulating body 10.

In this embodiment, referring to FIG. 1 and FIG. 2, side edges of two side surfaces of the housing 16 away from the top surface of the housing 16 further comprise a plurality of pins 169. The plurality of pins 169 protrude from the side edges of the two side surfaces of the housing 16 away from the top surface of the housing 16 along the third direction Z.

Figure 15:
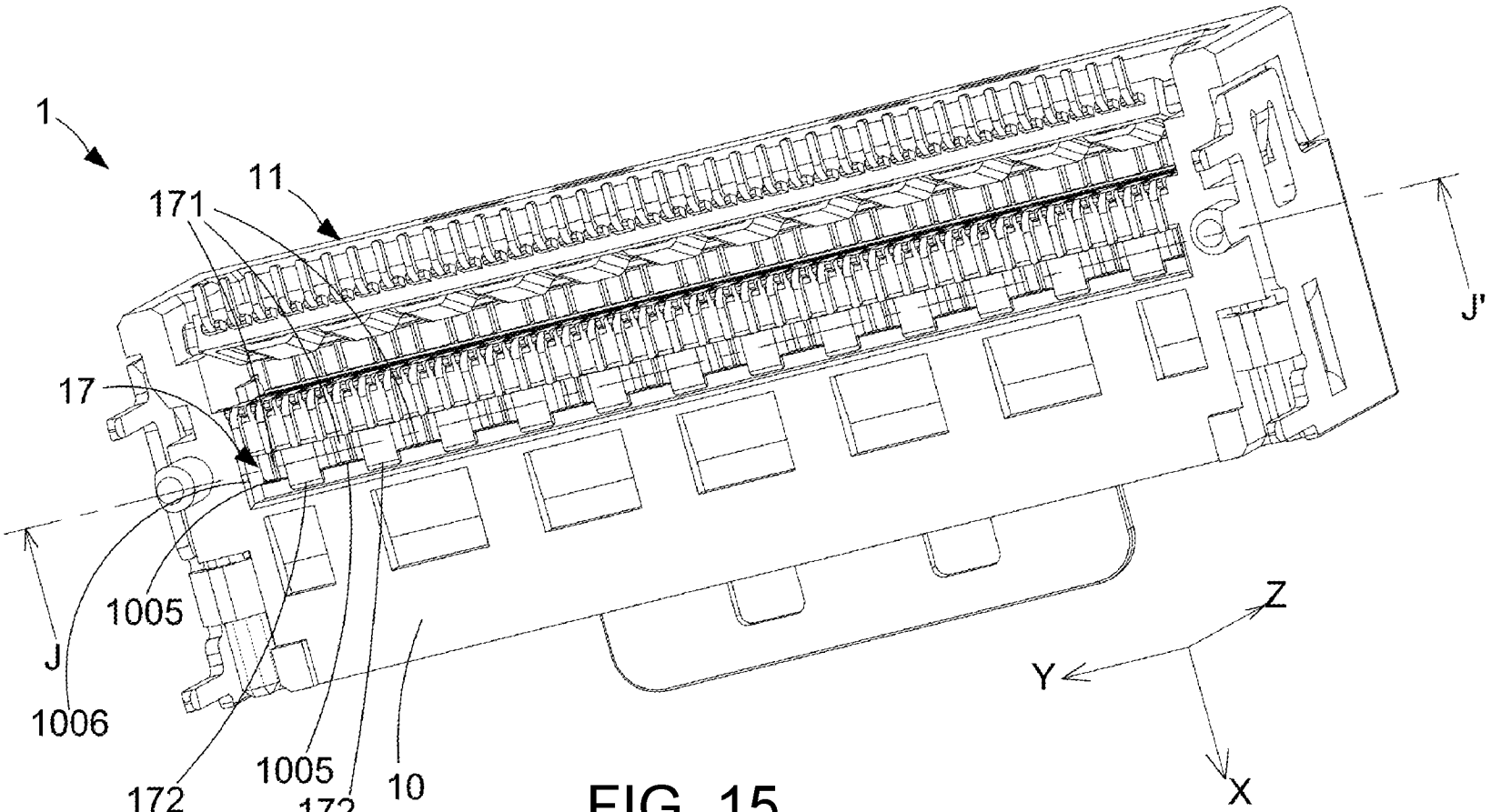
FIG. 15 is a perspective view of an electrical connector of the second embodiment of the present disclosure.
Figure 16:
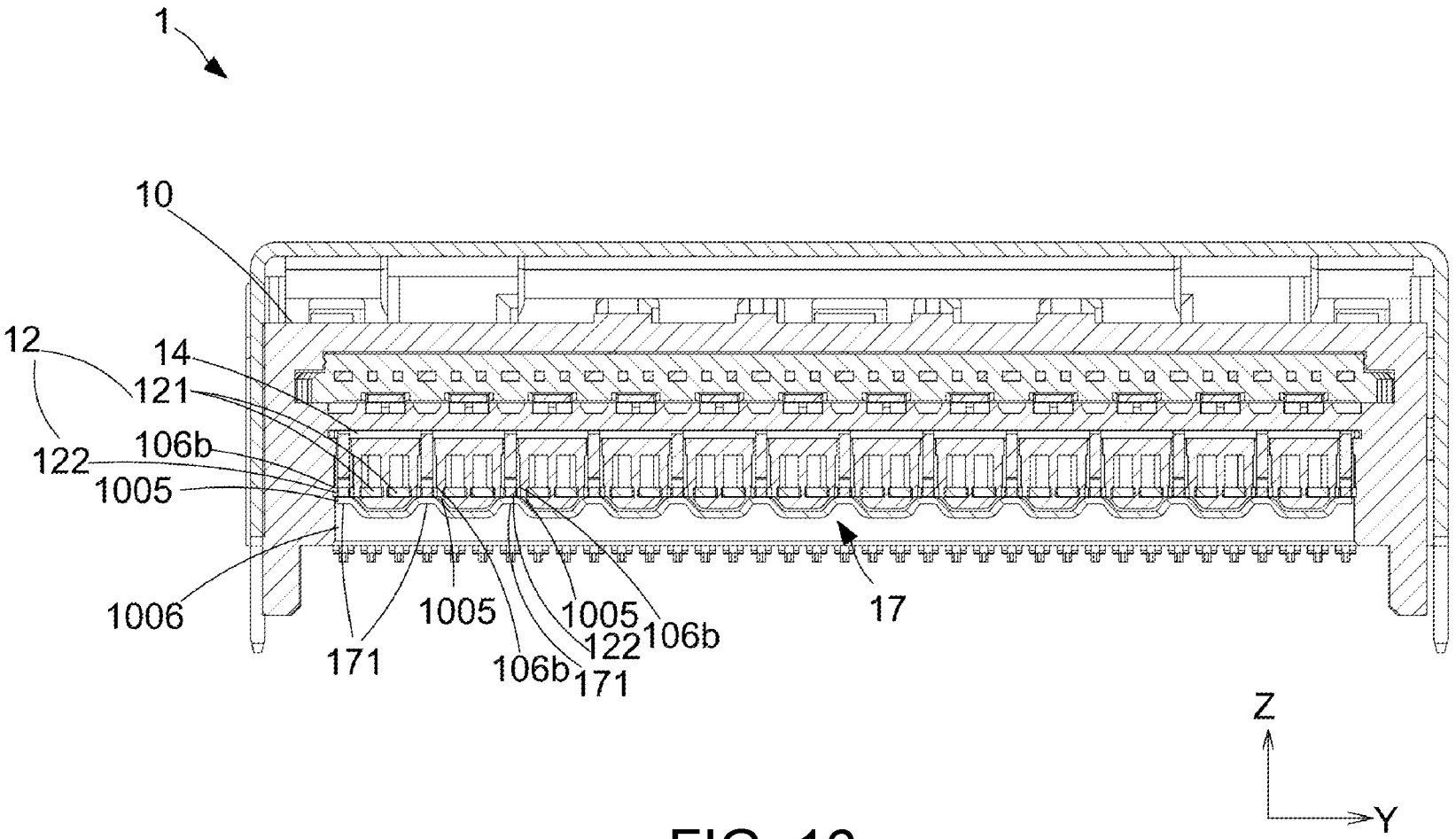
FIG. 16 is a cross-sectional view along line J-J' of FIG. 15.

FIG. 15 is a perspective view of an electrical connector of the second embodiment of the present disclosure. FIG. 16 is a cross-sectional view along line J-J' of FIG. 15. As shown in the figures, in this embodiment, the electrical connector 1 is different from that of the first embodiment in that a fourth electromagnetic shielding member 17 is additionally disposed. A bottom surface of the insulating body 10 further comprises a plurality of fourth hollow parts 1005. The plurality of fourth hollow parts 1005 are respectively communicated with a plurality of second terminal plugging slots **106*b*. A plurality of second ground terminals 122 are respectively exposed from the plurality of fourth hollow parts 1005. The fourth electromagnetic shielding member 17 comprises a plurality of second contacting bumps 171 disposed at intervals. The plurality of second contacting bumps 171 extend along the third direction Z. When the fourth electromagnetic shielding member 17 is disposed on the insulating body 10, the plurality of second contacting bumps 171 would respectively enter the plurality of fourth hollow parts 1005, the plurality of second contacting bumps 171 would be respectively in contact with the plurality of second ground terminals 122, and the fourth electromagnetic shielding member 17 disposed at the two second contacting bumps 171 would be in contact with the insulating body 10 disposed between the two fourth hollow parts 1005. In this way, the fourth electromagnetic shielding member 17 could electromagnetically shield the plurality of second signal terminals 121, which effectively improves the electromagnetic shielding performance of the electrical connector 1. In this embodiment, the cross-sectional shape of the fourth hollow part 1005 is identical to the cross-sectional shape of the second contacting bump 171, so that the plurality of second contacting bumps 171 of the fourth electromagnetic shielding member 17 can be stably engaged with the plurality of fourth hollow parts 1005, respectively. This also indicates that the fourth electromagnetic shielding member 17 can be directly assembled to the insulating body 10. In this embodiment, the fourth electromagnetic shielding member 17** is wave-shaped.

In this embodiment, the bottom surface of the insulating body 10 further comprises a second retaining part 1006. The plurality of fourth hollow parts 1005 are disposed in the second retaining part 1006. The fourth electromagnetic shielding member 17 is disposed in the second retaining part 1006 so that the fourth electromagnetic shielding member 17 does not protrude from the bottom surface of the insulating body 10. In this embodiment, the fourth electromagnetic shielding member 17 further comprises a plurality of second positioning bumps 172 respectively disposed between two adjacent second contacting bumps 171. The plurality of second positioning bumps 172 extend along the first direction X. When the plurality of second contacting bumps 171 are assembled to the plurality of fourth hollow parts 1005, the plurality of second positioning bumps 172 would abut against a surface of the second retaining part 1006 in the third direction Z to position the fourth electromagnetic shielding member 17 in the second retaining part 1006. In this way, the plurality of second contacting bumps 171 can be accurately disposed in the plurality of fourth hollow parts 1005, respectively.

In this embodiment, the first electromagnetic shielding member electromagnetically shields the plurality of first signal terminals of the first terminal module 11. The second electromagnetic shielding member 14 and the fourth electromagnetic shielding member 17 cover the plurality of second signal terminals 121 of the second terminal module 12 to electromagnetically shield the plurality of covered second signal terminals 121. In this way, the electromagnetic interference or external electromagnetic interference generated by the plurality of second signal terminals 121 can be completely shielded, so that the electrical connector 1 could excellently perform electromagnetic shielding.

Figure 17:
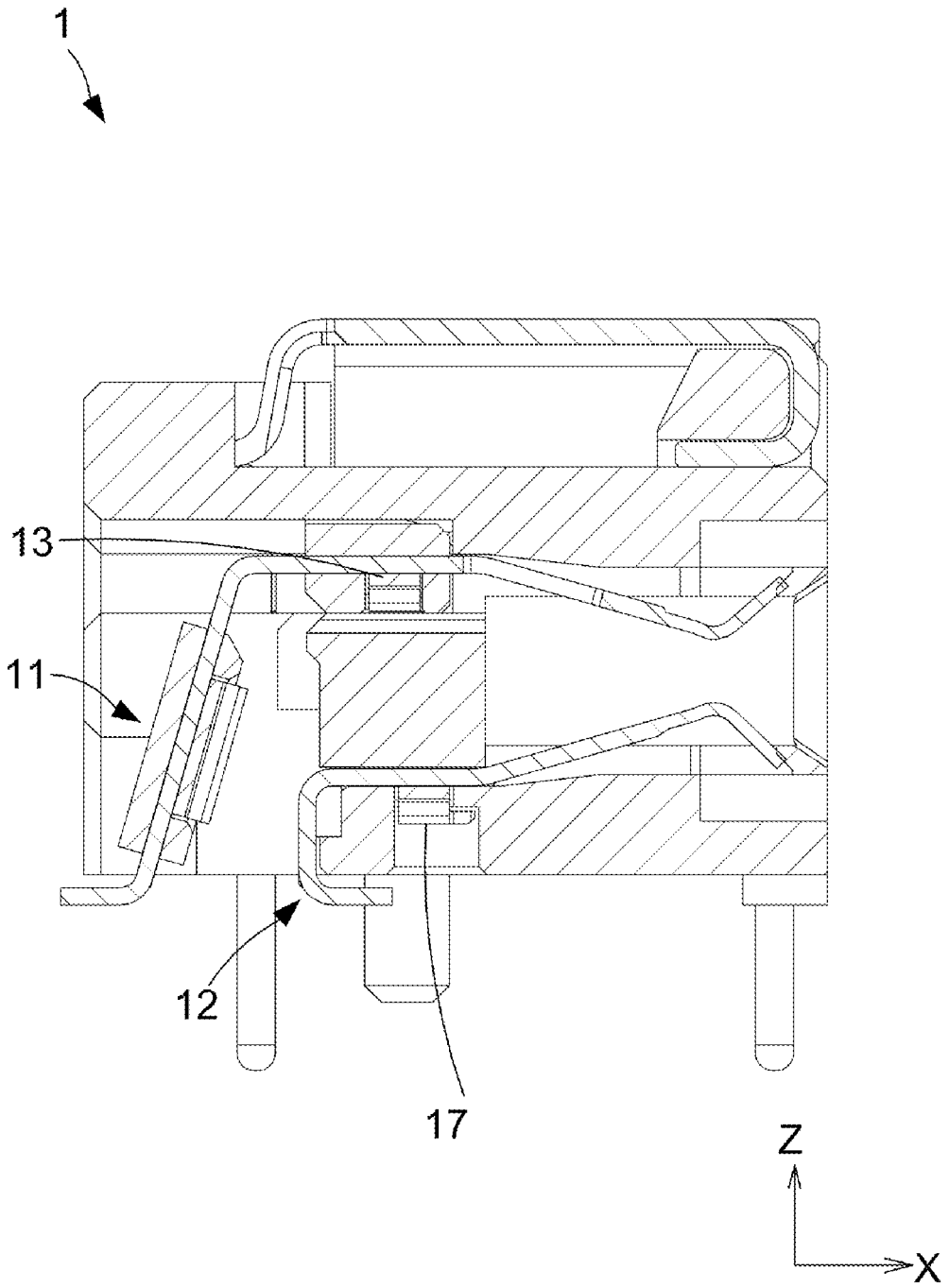
FIG. 17 is a cross-sectional view of an electrical connector of the third embodiment of the present disclosure.

FIG. 17 is a cross-sectional view of an electrical connector of the third embodiment of the present disclosure. As shown in the figure, in this embodiment, the electrical connector 1 is different from that of the second embodiment in that the second electromagnetic shielding member is omitted. In this embodiment, the electrical connector 1 is only provided with a first electromagnetic shielding member 13 and a fourth electromagnetic shielding member 17. The first electromagnetic shielding member 13 electromagnetically shields a plurality of first signal terminals of a first terminal module 11. The fourth electromagnetic shielding member 17 electromagnetically shields a plurality of second signal terminals of a second terminal module 12.

Figure 18:
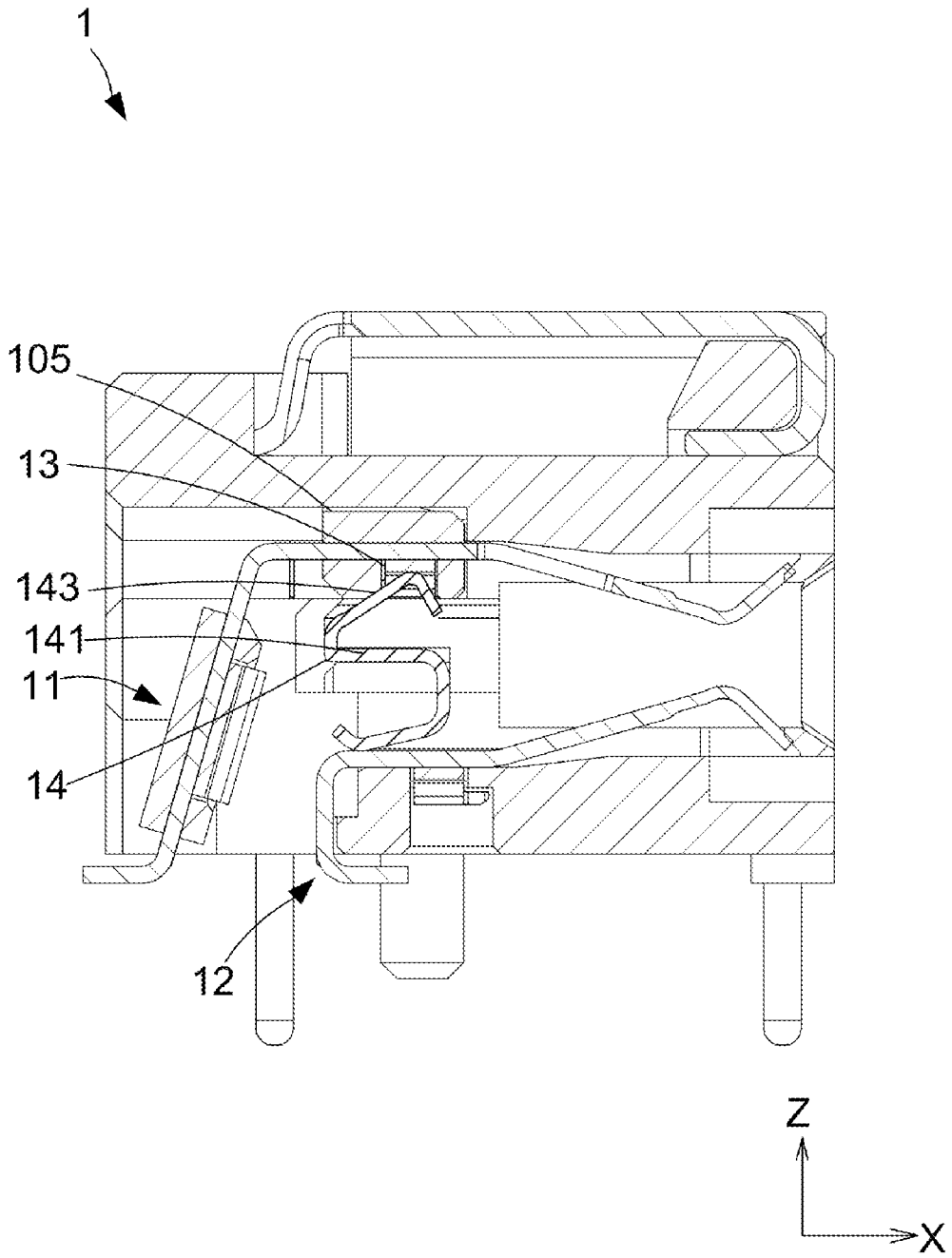
FIG. 18 is a cross-sectional view of an electrical connector of the fourth embodiment of the present disclosure.

FIG. 18 is a cross-sectional view of an electrical connector of the fourth embodiment of the present disclosure. As shown in the figure, in this embodiment, the electrical connector 1 is different from that of the second embodiment in that the second electromagnetic shielding member 14 further comprises a plurality of upper contacting elastic pieces 143 disposed at intervals. The plurality of upper contacting elastic pieces 143 are disposed at the other side of an electromagnetic shielding body 141. The extending direction of the plurality of upper contacting elastic pieces 143 is opposite to the extending direction of a plurality of lower contacting elastic pieces 142. One ends of the plurality of upper contacting elastic pieces 143 away from the electromagnetic shielding body 141 pass through a terminal accommodating groove 105 to respectively contact with a first electromagnetic shielding member 13. The first electromagnetic shielding component 13 and a fourth electromagnetic shielding component 17 are connected through the second electromagnetic shielding component 14 so that the electromagnetic shielding performance of the electrical connector 1 can be improved.

Figure 19:
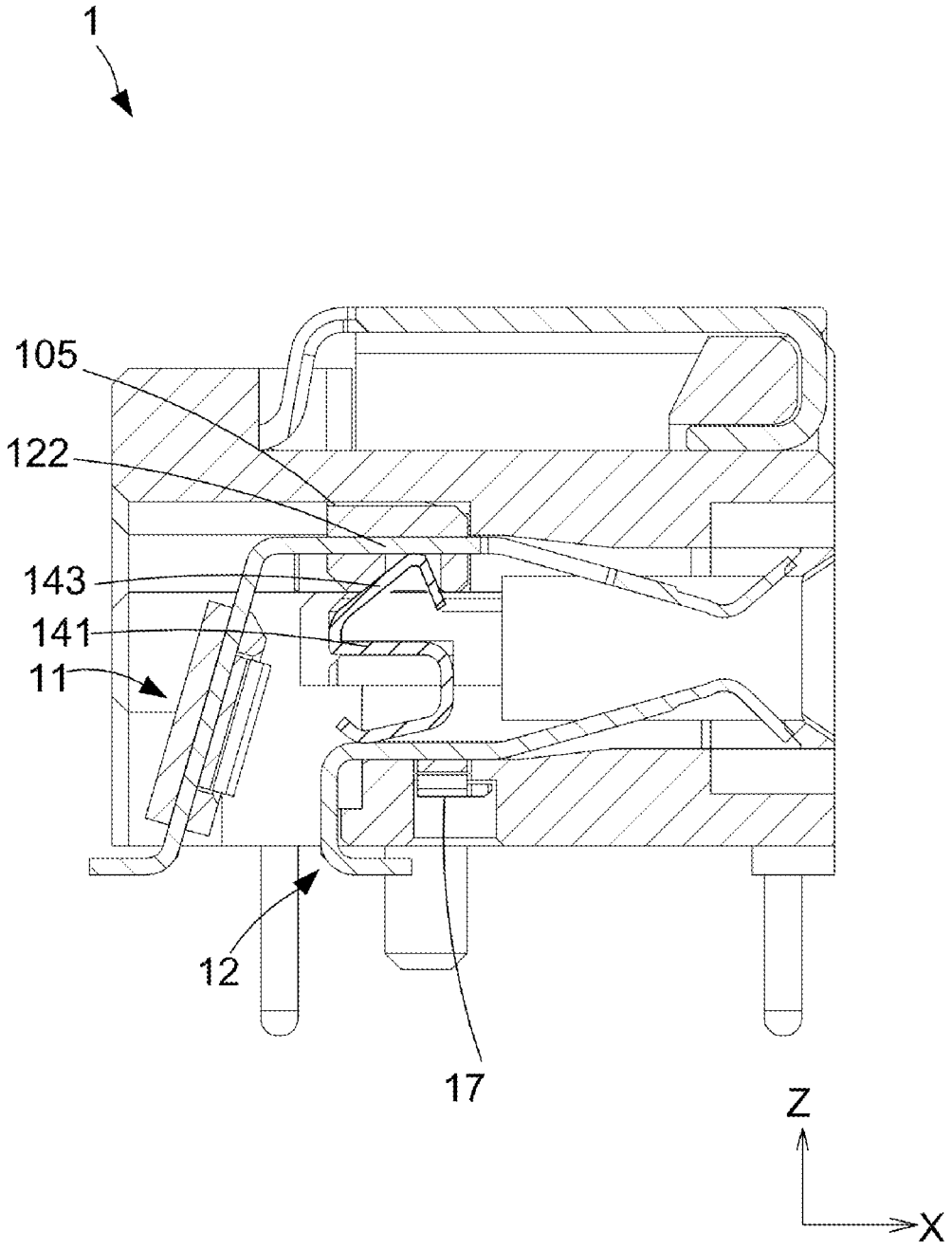
FIG. 19 is a cross-sectional view of an electrical connector of the fifth embodiment of the present disclosure.

FIG. 19 is a cross-sectional view of an electrical connector of the fifth embodiment of the present disclosure. As shown in the figure, in this embodiment, the electrical connector 1 is different from that of the fourth embodiment in that the first electromagnetic shielding member is omitted. One ends of the plurality of upper contacting elastic pieces 143 away from an electromagnetic shielding body 141 pass through a terminal accommodating groove 105 to respectively contact with a plurality of first ground terminals 112. A second electromagnetic shielding member 14 could electromagnetically shield a plurality of first signal terminals of a first terminal module 11 and a plurality of second signal terminals of a second terminal module 12 simultaneously.

In other embodiments, a plurality of lower contacting elastic pieces can be omitted to allow a second electromagnetic shielding member 14 only to contact with a plurality of first ground terminals 112 of a first terminal module 11 to electromagnetically shield a plurality of first signal terminals of the first terminal module 11. A fourth electromagnetic shielding member 17 could electromagnetically shield a plurality of second signal terminals of a second terminal module 12.

Figure 20:
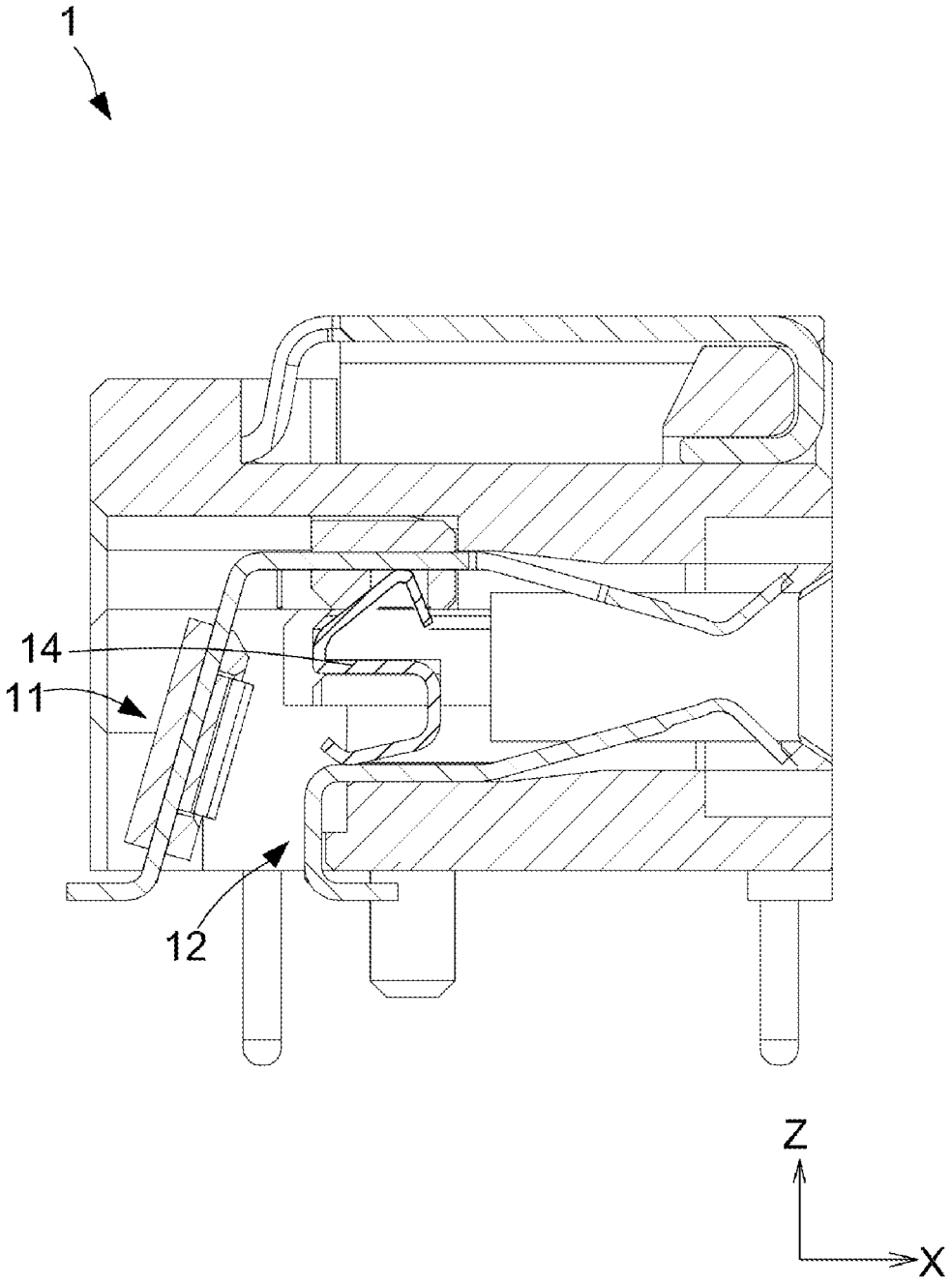
FIG. 20 is a cross-sectional view of an electrical connector of the sixth embodiment of the present disclosure.

FIG. 20 is a cross-sectional view of an electrical connector of the sixth embodiment of the present disclosure. As shown in the figure, in this embodiment, the electrical connector 1 is different from that of the fifth embodiment in that the fourth electromagnetic shielding member is omitted. A second electromagnetic shielding member 14 can electromagnetically shield a plurality of first signal terminals of a first terminal module 11 and a plurality of second signal terminals of a second terminal module 12 simultaneously.

In the above description, the electromagnetic shielding component of the present disclosure can be an arbitrary combination of the first electromagnetic shielding member, the second electromagnetic shielding member, and the fourth electromagnetic shielding member, for example, a combination of the first electromagnetic shielding member and the second electromagnetic shielding member (first embodiment), a combination of the first electromagnetic shielding member, the second electromagnetic shielding member, and the fourth electromagnetic shielding member (the second embodiment and the fourth embodiment), a combination of the first electromagnetic shielding member and the fourth electromagnetic shielding member (third embodiment), a combination of the second electromagnetic shielding member and the fourth electromagnetic shielding member (fifth embodiment), and the only second electromagnetic shielding member (sixth embodiment).

In summary, embodiments of the present disclosure provide an electrical connector. By disposing the electromagnetic shielding component in the insulating body or/and the first terminal insulating body of the first terminal module in a physical mounting manner, the assembling can be easy and the complexity of manufacturing can be reduced. Meanwhile, the electromagnetic shielding components can be arbitrarily replaced, which greatly improves the convenience of use.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

an insulating body comprising a first surface, a second surface, a terminal accommodating groove, a plurality of first terminal plugging slots and a plurality of second terminal plugging slots, the first surface and the second surface being oppositely disposed and being disposed on a first direction, the plurality of first terminal plugging slots and the plurality of second terminal plugging slots being disposed at intervals at one side of the terminal accommodating groove along a second direction orthogonal to the first direction;

a first terminal module comprising a plurality of first signal terminals, a plurality of first ground terminals and a first terminal insulating body, the first terminal insulating body covering a part of the plurality of first signal terminals and a part of the plurality of first ground terminals, the first terminal insulating body being disposed in the terminal accommodating groove;

a second terminal module comprising a plurality of second signal terminals and a plurality of second ground terminals, the plurality of second signal terminals being respectively assembled in the plurality of first terminal plugging slots, the plurality of second ground terminals being respectively assembled in the plurality of second terminal plugging slots; and an electromagnetic shielding component disposed at the insulating body or/and at the first terminal insulating body, the electromagnetic shielding component being in contact with the plurality of first ground terminals and the plurality of second ground terminals;

wherein the electromagnetic shielding component comprises a second electromagnetic shielding member; the second electromagnetic shielding member is assembled to the insulating body, and is in contact with the plurality of second ground terminals or is in contact with the first ground terminals and the plurality of second ground terminals.

2. The electrical connector according to claim 1, wherein the insulating body comprises a first plugging slot and a second plugging slot; the first plugging slot is disposed on the first surface; the second plugging slot is disposed on the second surface; the terminal accommodating groove, the plurality of first terminal plugging slots, and the plurality of second terminal plugging slots are disposed between the first plugging slot and the second plugging slot; the plurality of first terminal plugging slots are communicating with the first plugging slot; the plurality of second terminal plugging slots are communicating with the second plugging slot; one end of the plurality of first signal terminals, one end of the plurality of first ground terminals, one end of the plurality of second signal terminals, and one end of the plurality of second ground terminals are disposed in the first plugging slot; the other end of the plurality of first signal terminals, the other end of the plurality of first ground terminals, the other end of the plurality of second signal terminals, and the other end of the plurality of second ground terminals are disposed in the second plugging slot.

3. The electrical connector according to claim 2, wherein the electromagnetic shielding component further comprises a first electromagnetic shielding member; the first electromagnetic shielding member is disposed on the first terminal insulating body and is in contact with the plurality of first ground terminals.

4. The electrical connector according to claim 3, wherein the first terminal insulating body comprises a plurality of first hollow parts; the plurality of first ground terminals are respectively exposed from the plurality of first hollow parts; the first electromagnetic shielding member comprises a plurality of first contacting bumps; the plurality of first contacting bumps are respectively engaged with the plurality of first hollow parts and are in contact with the plurality of first ground terminals.

5. The electrical connector according to claim 4, wherein the first terminal insulating body comprises a first retaining part in which the plurality of first hollow parts are disposed; the plurality of first hollow parts are communicating with the first retaining part; the first electromagnetic shielding member is disposed in the first retaining part.

6. The electrical connector according to claim 4, wherein the first terminal insulating body comprises a plurality of positioning recesses; two positioning recesses exists between two first hollow parts; the first electromagnetic shielding member comprises a plurality of first positioning bumps; the plurality of first positioning bumps are respectively disposed between two adjacent first contacting bumps; the plurality of first positioning bumps are respectively disposed in the plurality of positioning recesses.

7. The electrical connector according to claim 3, wherein the second electromagnetic shielding member comprises an electromagnetic shielding body and a plurality of lower contacting elastic pieces; the plurality of lower contacting elastic pieces are disposed at one side of the electromagnetic shielding body along the second direction at intervals.

8. The electrical connector according to claim 7, wherein the insulating body comprises a first electromagnetic shield accommodating groove and a plurality of electromagnetic shield contacting grooves; the first electromagnetic shield accommodating groove is disposed between the terminal accommodating groove, the plurality of first terminal plugging slots, and the plurality of second terminal plugging slots; the first electromagnetic shield accommodating groove communicates with the second plugging slot; the plurality of electromagnetic shield contacting grooves are disposed between the first electromagnetic shield accommodating groove, the plurality of first terminal plugging slots, and the plurality of second terminal plugging slots along the second direction at intervals; the plurality of electromagnetic shield contacting grooves are respectively communicated with the first electromagnetic shield accommodating groove and the plurality of second terminal plugging slots; the electromagnetic shielding body is disposed in the first electromagnetic shield accommodating groove; the plurality of lower contacting elastic pieces are respectively disposed in the plurality of electromagnetic shield contacting grooves and are respectively in contact with the plurality of second ground terminals.

9. The electrical connector according to claim 7, wherein the second electromagnetic shielding member comprises a plurality of upper contacting elastic pieces; the plurality of upper contacting elastic pieces are disposed at the other side of the electromagnetic shielding body along the second direction at intervals; the extending directions of the plurality of lower contacting elastic pieces are opposite to the extending directions of the plurality of upper contacting elastic pieces; the plurality of upper contacting elastic pieces pass through the terminal accommodating groove and are respectively in contact with the plurality of first ground terminals.

10. The electrical connector according to claim 3, wherein the first terminal module comprises a second terminal insulating body; the second terminal insulating body covers a part of the plurality of first signal terminals and the plurality of first ground terminals; the second terminal insulating body comprises a second hollow part; the plurality of first signal terminals and the plurality of first ground terminals are respectively exposed from the second hollow part; the electromagnetic shielding component comprises a third electromagnetic shielding member; the third electromagnetic shielding member is disposed in the second hollow part and is in contact with the plurality of first ground terminals.

11. The electrical connector according to claim 2, wherein the electromagnetic shielding component further comprises a fourth electromagnetic shielding member; the fourth electromagnetic shielding member is in contact with the plurality of second ground terminals.

12. The electrical connector according to claim 11, wherein the insulating body comprises a first electromagnetic shield accommodating groove; the first electromagnetic shield accommodating groove is disposed between the terminal accommodating groove, the plurality of first terminal plugging slots, and the plurality of second terminal plugging slots; the first electromagnetic shield accommodating groove communicates with the second plugging slot; the second electromagnetic shielding member comprises an electromagnetic shielding body and a plurality of upper contacting elastic pieces; the plurality of upper contacting elastic pieces are disposed at one side of the electromagnetic shielding body along the second direction at intervals; the electromagnetic shielding body is disposed in the first electromagnetic shield accommodating groove; the plurality of upper contacting elastic pieces pass through the terminal accommodating groove and are respectively in contact with the plurality of first ground terminals.

13. The electrical connector according to claim 2, wherein two sides of the first terminal insulating body are respectively provided with an elastic arm; one end of the elastic arm is disposed at the first terminal insulating body, while the other end of the elastic arm is a movable end; a gap exists between the elastic arm and the first terminal insulating body; the other end of the elastic arm is provided with a buckling bump; the buckling bump extends in a direction away from the first terminal insulating body along the second direction; an oppositely disposed inner surface of the insulating body is respectively provided with a guiding groove in the second direction; the guiding groove passes through the second plugging slot and the terminal accommodating groove; an inner surface of the guiding groove in the second direction comprises a buckling through hole; the elastic arm is disposed in the guiding groove; the buckling bump is disposed in the buckling through hole.

14. The electrical connector according to claim 2, wherein two opposite sidewalls of the second plugging slot in the second direction respectively comprise a limiting groove; the first terminal module comprises a second terminal insulating body; the second terminal insulating body covers a part of the plurality of first signal terminals and the plurality of first ground terminals disposed in the second plugging slot; two opposite sides of the second terminal insulating body in the second direction are respectively provided with a limiting bump; the limiting bump is disposed in the limiting groove.

15. The electrical connector according to claim 1, wherein the electromagnetic shielding component comprises a first electromagnetic shielding member and a fourth electromagnetic shielding member; the first electromagnetic shielding member is disposed at the first terminal insulating body and is in contact with the plurality of first ground terminals; the fourth electromagnetic shielding member is disposed at the insulating body and is in contact with the plurality of second ground terminals.

16. The electrical connector according to claim 15, wherein a surface of the insulating body in a third direction orthogonal to the first direction and the second direction comprises a plurality of second hollow parts; the plurality of second ground terminals are respectively exposed from the plurality of second hollow parts; the fourth electromagnetic shielding member comprises a plurality of second contacting bumps; the plurality of second contacting bumps are respectively engaged with the plurality of second hollow parts and are respectively in contact with the plurality of second ground terminals.

17. The electrical connector according to claim 16, wherein the surface of the insulating body in the third direction comprises a second retaining part; the plurality of second hollow parts are disposed in the second retaining part; the plurality of second hollow parts communicate with the second retaining part; the fourth electromagnetic shielding member is disposed in the second retaining part.

18. The electrical connector according to claim 17, wherein the fourth electromagnetic shielding member comprises a plurality of second positioning bumps; the plurality of second positioning bumps are respectively disposed between two adjacent second contacting bumps; the plurality of second positioning bumps abut against a surface of the second retaining part in the third direction.

19. The electrical connector according to claim 1, wherein the insulating body comprises a first electromagnetic shield accommodating groove and a plurality of electromagnetic shield contacting grooves; the first electromagnetic shield accommodating groove is disposed between the terminal accommodating groove, the plurality of first terminal plugging slots, and the plurality of second terminal plugging slots; the first electromagnetic shield accommodating groove communicates with the second plugging slot; the plurality of electromagnetic shield contacting grooves are disposed between the first electromagnetic shield accommodating groove, the plurality of first terminal plugging slots, and the plurality of second terminal plugging slots along the second direction at intervals; the plurality of electromagnetic shield contacting grooves are respectively communicated with the first electromagnetic shield accommodating groove and the plurality of second terminal plugging slots; the second electromagnetic shielding member comprises an electromagnetic shielding body, a plurality of lower contacting elastic pieces, and a plurality of upper contacting elastic pieces; the plurality of lower contacting elastic pieces are disposed at one side of the electromagnetic shielding body along the second direction at intervals; the plurality of upper contacting elastic pieces are disposed at the other side of the electromagnetic shielding body along the second direction at intervals; the extending directions of the plurality of lower contacting elastic pieces are opposite to the extending directions of the plurality of upper contacting elastic pieces; the electromagnetic shielding body is disposed in the first electromagnetic shield accommodating groove; the plurality of lower contacting elastic pieces are respectively disposed in the plurality of electromagnetic shield contacting grooves and are respectively in contact with the plurality of second ground terminals; the plurality of upper contacting elastic pieces pass through the terminal accommodating groove and are respectively in contact with the plurality of first ground terminals.

20. The electrical connector according to claim 1, wherein a surface of the first terminal insulating body in a third direction orthogonal to the first direction and the second direction and away from the bottom surface of the insulating body comprises a plurality of second ribs disposed at intervals; the plurality of second ribs are in contact with a surface of the terminal accommodating groove in the third direction and away from the bottom surface of the insulating body.

21. The electrical connector according to claim 1 comprising a housing disposed at one side of the insulating body, the housing covering a top surface and two opposite side surfaces in the second direction of the insulating body, a bottom surface of the insulating body being exposed from the housing.

22. The electrical connector according to claim 21, wherein the top surface of the insulating body comprises a first positioning notch and two second positioning notches; the two second positioning notches are disposed on two sides of the first positioning notch; the first positioning notch and the housing form a first positioning part; the two second positioning notches and the housing form a second positioning part.

23. The electrical connector according to claim 22, wherein a side edge of the housing in the first direction comprises a plurality of positioning pieces; a sidewall of the first positioning notch in the first direction and close to the second surface comprises a plurality of positioning plug holes disposed at intervals; the plurality of positioning pieces are respectively inserted into the plurality of positioning plug holes.

24. The electrical connector according to claim 23, wherein the plurality of positioning pieces respectively comprise a first positioning piece body and the second positioning piece body connected with the first positioning piece body; the first positioning piece body extends along a third direction orthogonal to the first direction and the second direction; the second positioning piece body extends along the first direction; the first positioning piece body is disposed in the first positioning notch; the second positioning piece body is inserted into the corresponding positioning plug hole.

25. The electrical connector according to claim 22, wherein a side edge of a top surface of the housing comprises a plurality of first buckling pieces; the plurality of first buckling pieces comprise a buckling hole; the top surface of the insulating body comprises a plurality of first buckling grooves and a plurality of buckling blocks disposed at intervals; the plurality of first buckling grooves extend along the third direction orthogonal to the first direction and the second direction; the plurality of buckling blocks are respectively disposed on the surfaces of the plurality of first buckling grooves in the third direction; the plurality of first buckling pieces are respectively disposed in the plurality of first buckling grooves; the plurality of buckling blocks are respectively disposed in the buckling holes of the plurality of first buckling pieces.

26. The electrical connector according to claim 25, wherein the plurality of first buckling pieces respectively comprise a first buckling piece body and a second buckling piece body connected with the first buckling piece body; the first buckling piece body extends along the third direction; the second buckling piece body extends along the first direction; the buckling hole is disposed on the second buckling piece body; the first buckling piece body is disposed in the first positioning notch; the second buckling piece body is disposed in the first buckling groove; the buckling block in the first buckling groove is disposed in the buckling hole.

27. The electrical connector according to claim 22, wherein a side edge of a top surface of the housing comprises two second buckling pieces; the two second buckling pieces respectively comprise a first connecting end and a buckling end; the first connecting end is disposed at the side edge of the top surface of the housing; the buckling end is disposed in the housing; the first surface of the insulating body comprises two second buckling grooves; the two second buckling grooves are respectively disposed between the first positioning notch and the second positioning notch; the two second buckling grooves respectively extend along the first direction; the two second buckling pieces are respectively inserted into the two second buckling grooves.

28. The electrical connector according to claim 27, wherein the two second buckling pieces respectively comprise an interfering part interfering with a sidewall of the second buckling groove.

29. The electrical connector according to claim 21, wherein the bottom surface of the insulating body comprises two limiting recess respectively close to two side surfaces of the housing; the two limiting recesses extend along the first direction from the first surface of the insulating body to the second surface of the insulating body; the side edges of the two side surfaces of the housing in a third direction orthogonal to the first direction and the second direction and away from the top surface of the housing respectively comprise a limiting piece; the limiting piece comprises a second connecting end and a limiting end; the second connecting end is disposed on the side edges of the two side surfaces of the housing in the third direction and away from the top surface of the housing; the limiting end is disposed in the housing.

30. The electrical connector according to claim 21, wherein the two opposite side surfaces in the second direction of the insulating body respectively comprise a guiding recess; the guiding recess extends from the first surface of the insulating body to the second surface of the insulating body along the first direction; the two side surfaces of the housing respectively comprise a guiding bump; the guiding bump protrudes into the housing; the guiding bump is disposed in the guiding recess.

31. The electrical connector according to claim 21, wherein the two opposite side surfaces in the second direction of the insulating body respectively comprise a positioning groove; the positioning groove extends from the bottom surface of the insulating body to the top surface of the insulating body along a third direction orthogonal to the first direction and the second direction; the positioning groove comprises an abutting inclined surface and a limiting surface in the first direction; the limiting surface is farther than the abutting inclined surface from the second surface; the two side surfaces of the housing respectively comprise a retaining hole and a limiting elastic piece; one end of the limiting elastic piece is connected with a side edge of the retaining hole in the first direction and close to the second surface; the limiting elastic piece extends along the first direction; the other end of the limiting elastic piece is movably disposed in the retaining hole; the limiting elastic piece abuts against the abutting inclined surface; the other end of the limiting elastic piece corresponds to the limiting surface.

32. An electrical connector, comprising:

an insulating body comprising a first surface, a second surface, a terminal accommodating groove, a plurality of first terminal plugging slots and a plurality of second terminal plugging slots, the first surface and the second surface being oppositely disposed and being disposed on a first direction, the plurality of first terminal plugging slots and the plurality of second terminal plugging slots being disposed at intervals at one side of the terminal accommodating groove along a second direction orthogonal to the first direction;

a first terminal module comprising a plurality of first signal terminals, a plurality of first ground terminals and a first terminal insulating body, the first terminal insulating body covering a part of the plurality of first signal terminals and a part of the plurality of first ground terminals, the first terminal insulating body being disposed in the terminal accommodating groove;

a second terminal module comprising a plurality of second signal terminals and a plurality of second ground terminals, the plurality of second signal terminals being respectively assembled in the plurality of first terminal plugging slots, the plurality of second ground terminals being respectively assembled in the plurality of second terminal plugging slots; and an electromagnetic shielding component disposed at the insulating body or/and at the first terminal insulating body, the electromagnetic shielding component being in contact with the plurality of first ground terminals and the plurality of second ground terminals;

wherein the electromagnetic shielding component comprises a first electromagnetic shielding member and a fourth electromagnetic shielding member; the first electromagnetic shielding member is disposed at the first terminal insulating body and is in contact with the plurality of first ground terminals; the fourth electromagnetic shielding member is disposed at the insulating body and is in contact with the plurality of second ground terminals.

33. An electrical connector, comprising:

an insulating body comprising a first surface, a second surface, a terminal accommodating groove, a plurality of first terminal plugging slots and a plurality of second terminal plugging slots, the first surface and the second surface being oppositely disposed and being disposed on a first direction, the plurality of first terminal plugging slots and the plurality of second terminal plugging slots being disposed at intervals at one side of the terminal accommodating groove along a second direction orthogonal to the first direction;

a first terminal module comprising a plurality of first signal terminals, a plurality of first ground terminals and a first terminal insulating body, the first terminal insulating body covering a part of the plurality of first signal terminals and a part of the plurality of first ground terminals, the first terminal insulating body being disposed in the terminal accommodating groove;

a second terminal module comprising a plurality of second signal terminals and a plurality of second ground terminals, the plurality of second signal terminals being respectively assembled in the plurality of first terminal plugging slots, the plurality of second ground terminals being respectively assembled in the plurality of second terminal plugging slots; and an electromagnetic shielding component disposed at the insulating body or/and at the first terminal insulating body, the electromagnetic shielding component being in contact with the plurality of first ground terminals and the plurality of second ground terminals;

wherein a surface of the terminal accommodating groove in a third direction orthogonal to the first direction and the second direction and close to a bottom surface of the insulating body comprises a plurality of first ribs disposed at intervals; the plurality of first ribs support the first terminal insulating body.

* * * * *